US007267919B2

(12) United States Patent
Moribe et al.

(10) Patent No.: US 7,267,919 B2
(45) **Date of Patent: *Sep. 11, 2007**

(54) TONER

(75) Inventors: Syuhei Moribe, Shizuoka (JP); Hiroshi Yusa, Tokyo (JP); Takashige Kasuya, Shizuoka (JP); Yoshihiro Ogawa, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/378,349

(22) Filed: Mar. 20, 2006

(65) Prior Publication Data

US 2006/0177753 A1 Aug. 10, 2006

Related U.S. Application Data

(62) Division of application No. 11/212,638, filed on Aug. 29, 2005, now Pat. No. 7,097,951, which is a division of application No. 10/669,376, filed on Sep. 25, 2003, now Pat. No. 7,001,703.

(30) Foreign Application Priority Data

Sep. 27, 2002 (JP) ..... 2002-282737
Sep. 27, 2002 (JP) ..... 2002-282738

(51) Int. Cl.
*G03G 9/087* (2006.01)

(52) U.S. Cl. ..... 430/108.23; 430/108.8; 430/109.4; 430/111.4

(58) Field of Classification Search ..... 430/108.8, 430/109.4, 111.4, 108.23
See application file for complete search history.

(56) References Cited

U.S. PATENT DOCUMENTS 5,135,833 A 8/1992 Matsunaga et al. ..... 430/110

(Continued)

FOREIGN PATENT DOCUMENTS

EP 1241530 9/2002

(Continued)

OTHER PUBLICATIONS

Diamond, A.S., "Handbook of Imaging Materials", Marcel Dekker, Inc. (1991), pp. 163-170, 176-181.

*Primary Examiner*—Christopher RoDee
(74) *Attorney, Agent, or Firm*—Fitzpatrick, Cella, Harper & Scinto

(57) ABSTRACT

A toner of the present invention comprises at least a binder resin comprising as a main component a polyester resin, a wax, and a colorant, in which in case of measuring a wettability of the toner with respect to a mixed solvent of methanol and water in terms of an optical transimittance at an optical wavelength of 780 nm, a methanol concentration of the mixed solvent is in a range of 45 to 65% by volume when an optical transmittance is 80% and 10%, respectively; a melt index (MI) is of 0.1 to 10 g/10 min at a temperature of 125° C. and a load of 5 kg; the toner comparises a resin component insoluble to tetrahydrofuran (THF insoluble component) in an amount of 5 to 40% by mass based on a mass of the binder resin; and the toner comprises a THF soluble component having a main peak in a molecular weight region of 3,000 to 20,000, and has a proportion of a component having a molecular weight of 10,000 or less in the THF soluble component is 50% by mass or more, according to a chromatogram of the THF soluble component measured by gel permeation chromatography. According to the toner of the present invention, it is possible to control lowering of an image density after leaving under a high temperature and high humidity environment, and a decline in the image density due to a charge-rise phenomenon upon low rate printing. Further, the toner has excellent fixing property and high temperature offset characteristic, and occurring of the end-offset is controlled.

9 Claims, 4 Drawing Sheets

U.S. PATENT DOCUMENTS

| | | | | |
|---|---|---|---|---|
| 5,294,682 | A | 3/1994 | Fukuda et al. | 525/442 |
| 5,338,638 | A | 8/1994 | Tsuchiya et al. | 430/106 |
| 5,747,210 | A * | 5/1998 | Emoto et al. | 430/109.4 |
| 5,830,979 | A | 11/1998 | Nakayama et al. | 528/272 |
| 5,902,709 | A | 5/1999 | Nakayama et al. | 430/109 |
| 5,972,553 | A | 10/1999 | Katada et al. | 430/110 |
| 5,976,752 | A | 11/1999 | Matsunaga et al. | 430/110 |
| 6,002,895 | A | 12/1999 | Kasuya et al. | 399/111 |
| 6,238,834 | B1 | 5/2001 | Tamura et al. | 430/106.6 |
| 6,300,024 | B1 | 10/2001 | Yusa et al. | 430/45 |
| 6,485,875 | B1 | 11/2002 | Karaki et al. | 430/108.23 |
| 7,001,703 | B2 * | 2/2006 | Moribe et al. | 430/109.4 |

FOREIGN PATENT DOCUMENTS

| | | |
|---|---|---|
| JP | 5-27478 | 2/1993 |
| JP | 9-251216 | 9/1997 |
| JP | 9-251217 | 9/1997 |
| JP | 10-60104 | 3/1998 |
| JP | 10-69126 | 3/1998 |
| JP | 11-24312 | 1/1999 |
| JP | 11-194533 | 7/1999 |
| JP | 00-241030 | 9/2000 |
| JP | 00-242027 | 9/2000 |

* cited by examiner

TONER

CROSS-REFERENCE TO RELATED APPLICATION

This application is a division of application Ser. No. 11/212,638, filed on Aug. 29, 2005 now U.S. Pat. No. 7,097,951, which in turn, is a division of application Ser. No. 10/669,376, filed Sep. 25, 2003, now U.S. Pat. No. 7,001,703.

BACKGROUND OF THE INVENTION

This application claims the right of priority under 35 U.S.C. §119 based on Japanese Patent Application Nos. JP 2002-282737 and JP 2002-282738 which are hereby incorporated by reference herein in their entirety as if fully set forth herein.

FIELD OF THE INVENTION

The present invention relates to a toner used in image forming methods such as electrophotography, electrostatic recording, electrostatic printing, and toner-jetting recording system.

DESCRIPTION OF THE RELATED ART

Many proposals have been made with respect to a technique for improving the developing performance and durability of a toner, by controlling an affinity of the toner to a particular solvent. Examples of such technique include a technique in which a toner is dispersed into a mixed solvent of ethanol and water to measure the absorbance at the time, thereby finding an amount of magnetic iron oxides that exist on the surface of magnetic toner. With this technique, the extent of contamination a charging roller caused by the magnetic toner and the extent of the magnetic toners sticking to a photosensitive drum can be easily known (refer to JP11-194533A, for example).

Another example of such technique is a technique related to a toner having a predetermined wettability with respect to ethanol. In this technique, the hydrophobic property of the toner is expressed on the ethanol dropping transmittance curve, and the transmittance against the ethanol content by percentage is measured (refer to JP 2000-242027A, for example).

In addition to the given examples, there is a technique with which a charging property of a toner is improved by relating a surface condition of the magnetic toner with an absorbance of the magnetic toner dispersed in a methanol and water mixed solvent at the time (refer to EP1241530A1, for example).

Nevertheless, it is difficult to overcome all of the problems associated with recent increase in operation speed of electrophotographic devices such as problems which happen in and around a fixing device, end-offsetting, and a decline in the image density that is caused by charge-rise phenomenon of the toner.

Regarding to the polyester resin, which is used in toners, a tetrahydrofuran (THF) insoluble matter is 5% by mass or less, and in a THF soluble matter, proportions of ultra high molecular weight matter of $1\times10^6$ or more, high molecular weight matter of $1\times10^5$ or more, low molecular weight matter of less than $1\times10^4$, and middle molecular weight matter of $1\times10^4$ or more and less than $1\times10^5$ are defined (refer to JP10-60104A and JP 10-69126A, for example).

However, it is difficult to solve the problem of end-offset by only defining proportions of the various molecular weight cutoff of polyester resin.

In addition, the polyester resin for toner, wherein the polyester resin has a maximum of molecular weight in the range of $1\times10^3$ to $8\times10^3$, has a Mw/Mn ratio value in the range of 20 to 200; has no more than 80% by mass, to the whole resin, of a component of molecular weight $1\times10^5$ or less; and the polyester resin comprises polycarboxylic acid with 3 or more carboxyl groups and/or polyhydric alcohol with 3 or more hydroxyl groups; is known as polyester resin for electrophotographic toner (refer to JP 9-251216A, for example).

As disclosed in this publication, a toner having a wide non-offset temperature range is obtainable. However, charge control of the toner is insufficient such that the toner has a difficulty in complying with high speed.

In addition, a toner comprising polyester resin using oxyalkylene ether of novolak type phenolic resin is known as a toner comprising polyester resin (refer to JP 9-251217A and JP 11-24312A, for example).

However, the characteristic of the polyester resin is that it does not comprise tetrahydrofuran (THF) insoluble matter. Thus, this toner has difficulties in satisfying the high temperature offset property and developing performance in a higher level.

In addition, as a polyester resin for use a toner binder, there is a polyester resin for a toner binder that uses oxyalkylene ether of novolak type phenolic -resin (refer to JP 5-27478A, for example) is known. In addition, in regard to a toner, a toner which comprises a resin that comprises polycarboxylic acid component and polyol component, in which at least one part of the polyol component is oxyalkylene ether of novolak type phenolic resin with 3 or more hydroxyl groups, and a THF insoluble matter of 0.1 to 20% by mass(refer to JP 2000-242030A, for example) is known.

According to these inventions, the problems of high temperature offset property and fixing property are definitely improved. However, there is still a room for further improvement since a hydrophobicity of the toner is not yet controlled, and a property of the toner is still greatly influenced by an environment.

SUMMARY OF THE INVENTION

An object of the present invention is to provide a toner that solves the problems mentioned previously.

Another object of the present invention is to provide a toner with which lowering of image density after leaving the toner under high temperature and high humidity environment and lowering of the image density due to charge-rise phenomenon upon low rate printing are suppressed.

Further, still another object of the present invention is to provide a toner that has excellent fixing property and high temperature offset property, and that controls occurrence of end-offsetting.

The present invention relates to a toner comprising toner particles, each of the toner particles comprising at least a binder resin comprising a polyester resin as a main component, a wax, and a colorant, wherein in case of measuring a wettability of the toner with respect to a mixed solvent of methanol and water in terms of an optical transimittance at an optical wavelength of 780 nm, a methanol concentration of the mixed solvent is in a range of 45 to 65% by volume when the optical transmittance is 80%, and a methanol concentration of the mixed solvent is in a range of 45 to 65% by volume when the optical transmittance is 10%;

a melt index (MI) of the toner measured at a temperature of 125° C. and a load of 5 kg is in a range of 0.1 to 10 g/10 min;

the toner comprises a resin component insoluble to tetrahydrofuran (THF insoluble component) in an amount of 5 to 40% by mass based on a mass of the binder resin; and the toner comprises a tetrahydrofuran soluble component, and in case of measuring the tetrahydrofuran soluble component by gel permeation chromatography, a main peak is in a molecular weight region of 3,000 to 20,000, and a proportion of a component having a molecular weight of 10,000 or less in the tetrahydrofuran soluble component is 50% by mass or more in a chromatogram of the gel permeation chromatography.

According to the present invention, it is possible to provide a toner having excellent fixing property and high temperature offset property with which lowering of image density after leaving the toner under the high temperature and high humidity environment, and lowering of image density due to charge-rise phenomenon upon low rate printing are prevented, and end-offsetting and tailing are prevented.

Further, in the present invention, when the Carr's floodability index of toner is greater than 80 and the Carr's fluidity index of toner is greater than 60, it is more effective to provide a toner which exhibits an excellent charge stability even under a high-speed development system; which does not cause deterioration of an image and lowering of image density even after a prolonged use; which enables to obtain a uniform image without any fading under any conditions; which prevents sticking and fusing of the toner to the members where the toner comes in contact upon image formation (such as developer bearing member (sleeve) and electrostatic latent image member); and which enables to obtain an image without image deletion and tailing.

DETAILED DESCRIPTION OF THE PREFERRED EMBODIMENTS

Figure 1:
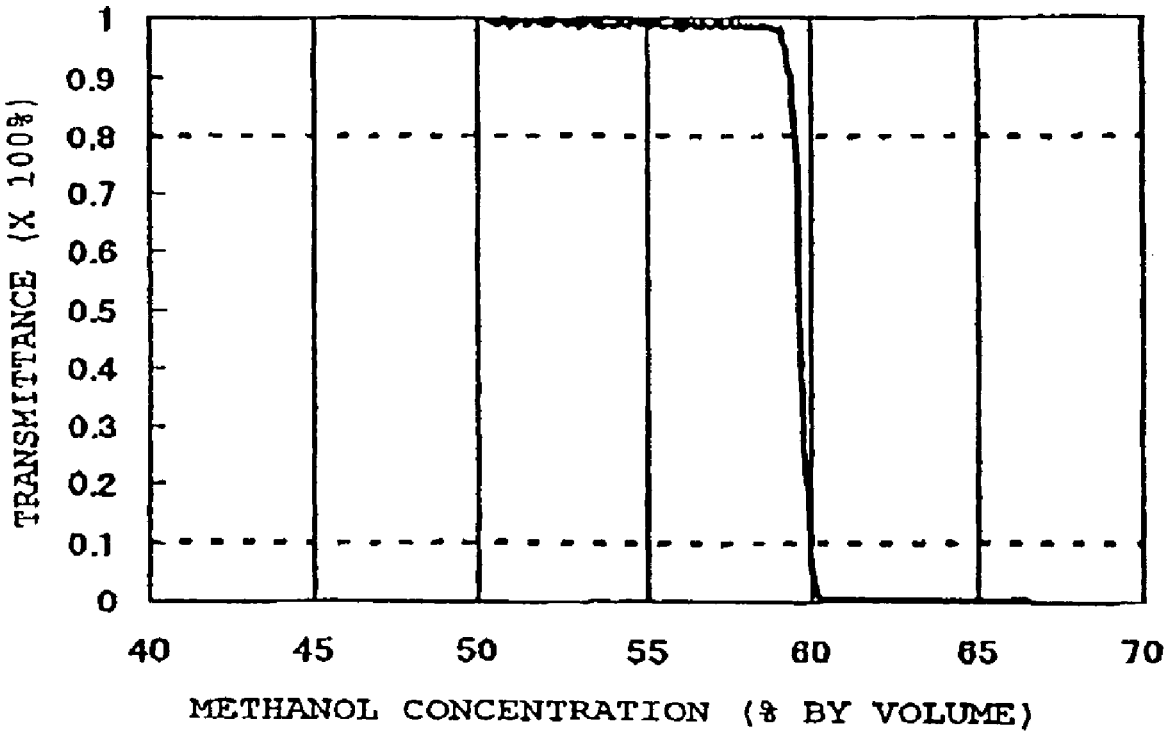
FIG. 1 is a graph showing transmittance of toner 1 of Embodiment 1 plotted against the methanol concentration.

When the operation speed of an electrophotographic device is to be increased, there is a need to elevate the setup temperature of a fixing device to secure sufficient fixing property. However, the temperature inside the electrophotographic device gets very hot, especially where the heat gets confined inside the electrophotographic device (temperature elevation inside of the electrophotographic device) like continuous two-sided printing. Since this being the case, the relative humidity inside the electrophotographic device gets low, causing the inside of the electrophotographic device to become dry. As a result of this, the amount of water content adsorbed at the surface of a toner particle gets extremely low, which in turn causes difficulty in leaking the electric charge from a toner, and the toner becomes liable to be excessively charged. When output of image at low rate printing under this condition is continued, the toner remains on a developing sleeve for a very long time with only a very small amount of the toner being consumed, and a number of times of friction with the development sleeve or development blade increases. Accordingly, the toner is excessively charged, leading to a problem known as the charge-rise causing low image density.

Besides this problem, a problem called end-offsetting is liable to occur if the fixation temperature is set high. To describe this in detail, when small sized papers (for example, postcard size) are being passed continuously, in a fixing nip part close to the center of the fixing device, a temperature will not rise dramatically since heat is absorbed by the paper in the nipper part where the paper is passed through. However, the heat tends to accumulate in the fixing nip part at the end of the fixing device where the paper does not pass through since the heat is not absorbed by the papers. Accordingly, the temperature of the fixing nip part gets extremely high. When a normal sized paper (for example, A4 paper) is passed through the fixing nip part under this condition, a problem that only end parts of the paper offset causes (end-offset).

This is different from the high temperature offset phenomenon where the toner is peeled off from the paper due to lowered toner viscosity by heat simply. In the end-offset phenomenon, the moisture contained in the paper is instantaneously evaporated by the heated nip part and the toner image developed on the paper is floated. Accordingly, adhesiveness between the toner and the paper is deteriorated, a transfer of the toner to heating roller side causes. Especially for the case of high-speed fixing device using a film heating system, an applied pressure cannot be set as high as that for the fixing device using a heating roller system. Thus, the strength of pressure for applying toner to the paper is small. Accordingly, the end-offset problem is liable to become more prominent.

As described above, the end-offset is caused by a fixing device heating to high temperature. Thus a toner should possess a sufficiently high temperature off setting property, as well as a physical property for withstanding the end-offsetting problem. In other words, the end-offset is different from the high temperature offset, and therefore, normal methods adapted to improve the problems of the high temperature offset, such as just increasing the toner melting viscosity and elasticity, or comprising release agent component such as wax in the toner, are not sufficient effective for improvement of the problem of the end-offset.

In order to improve the problems of end-offset and charge-rise which occur accompanying increase in operation speed of an image forming device, as a result of severe examination by the inventors, the previously described problems are solved to control the following factors. That is, a wettability of toner comprising polyester resin against a mixed solvent of methanol and water; a melt index (hereinafter referred to as MI) of the toner; an amount of an organic constituent insoluble to tetrahydrofuran (hereinafter also referred to as THF) of the toner; and molecular weight distribution of THF soluble component within the toner.

The wettability of the toner in respect to the mixed solvent of methanol and water is a parameter for indicating an extent of hydrophobicity of a surface of the toner. The wettability of the toner indicates that a hydrophobic property of the toner gets higher if a methanol ratio is higher when the toner is wet, and a hydrophobic property of the toner gets lower if a methanol ratio is lower when the toner is wet.

Regarding to the problems associated with charge-rise and end-offset, when measuring the wettability of a toner comprising polyester resin in respect to the mixed solvent of methanol and water at the optical transmittance having the wavelength of 780 nm, in case of the methanol concentration of the mixed solvent is in the range of 45 to 65% by volume when the transmittance is 80%, and the methanol concentration of the mixed solvent is in the range of 45 to 65% by volume when the transmittance is 10%, it is effective in regard to the problems.

Polyester resin has acid groups or hydroxyl groups in all of the molecular terminals, and therefore, affinity for a paper is high, enabling the toner to be attached to a paper strongly. Thus, even if moisture is evaporated from a paper, the polyester resin is effective in preventing the toner from floating from a surface of the paper, thereby the end-offset is controlled. In addition, the wettability of the toner comprising polyester resin in respect to the mixed solvent of methanol and water is set to the above range. This is effective in controlling the hydrophobicity of the toner to an appropriate range, and increasing the affinity of the toner for paper. Thereby the problems of the end-offset are remarkably improved.

In addition, the hydrophobicity of the toner is not excessively increased, and is controlled to an appropriate range. This way, even if humidity inside the electrophotographic device decreases due to temperature elevation inside the electrophotographic device, since it is possible for the polyester resin existing at the surface of toner particles to absorb appropriate amount of moisture, the excessive charge of the toner is leaked, and the charge-rise is controlled.

On the other hand, since the toner is liable to absorb moisture when the hydrophobicity is too low, if it is left standing under the high moisture environment, the amount of charge gets too small, and causes a problem of reduced image density. Henceforth, it is not preferable to make the hydrophobicity too low even for preventing the end-offset or the charge-rise.

In other words, according to the present invention, the hydrophobicity of the toner is controlled to an appropriate range, which is different from in contrast to the conventional technique that simply aims to elevate the hydrophobicity of the toner.

In case of measuring the wettability of toner in respect to the mixed solvent of methanol and water, at the optical transmittance having a light wavelength of 780 nm, if the methanol concentration is more than 65% by volume when the transmittance is 80%, or if the methanol concentration is more than 65% by volume when the transmittance is 10%, the hydrophobicity of the toner is too high. This is liable to decrease the affinity of toner for paper, to deteriorate the end-offset, and to lower an image density due to the charge-rise.

In case of measuring the wettability of toner in respect to the mixed solvent of methanol and water, at the optical transmittance having a light wavelength of 780 nm, if the methanol concentration is less than 45% by volume when the transmittance is 80%, or if the methanol concentration is less than 45% by volume when the transmittance is 10%, the hydrophobicity is too low. Thus, if the toner is left standing under high humidity, the toner absorbs moisture. Therefore, the toner is liable not to hold the charge, and the image density may likely be lowered.

Now, according to the present invention, from the viewpoint of effectively increasing the pre-mentioned effects, in the case of measuring the toner wettability in respect to the mixed solvent of methanol and water at the optical transmittance having the light wavelength of 780 nm, it is preferred that the methanol concentration is 50% by volume or more and less than 65% by volume when the transmittance is 80%, and methanol concentration is 50% by volume or more and less than 65% by volume when the transmittance is 10%. It is more preferred that the methanol-concentration is in the range of 55 to 64% by volume when the transmittance is 80%, and the methanol concentration is 60% by volume or more and less than 65% by volume when the transmittance is 10%.

According to the toner of the present invention, a melt index (MI) of the toner given the temperature of 125° C. and 5 kg load, is 0.1-10 g/10 min.

The toner of the present invention comprises 5 to 40% by mass of tetrahydrofuran (THF) insoluble components in respect to a binder resin. And in the present invention, in case of measuring a THF soluble component of the toner by gel permeation chromatography (GPC), a main peak is in the region of molecular weight 3,000 to 20,000, and a proportion of a component having molecular weight no more than 10,000 in the THF soluble component is 50% by mass or more in a chromatogram of the gel permeation chromatography.

In order to control the toner wettability in respect to the mixed solvent of methanol and water, a precise control of a surface condition of toner particles is required, particularlly, a precise control of the exposed condition of such materials as a wax and a colorant to the surface of the toner particle surface is required. By setting the MI of toner, the amount of THF insoluble component, and the GPC chromatogram to the range mentioned above, the melting viscosity of the toner becomes suitable for fine dispersion of the raw material at the melting and kneading process. Thus, exposed condition of the materials to the surface of the toner becomes uniform, and the wettability of the toner in respect to the mixed solvent of methanol and water is liable to be controlled. At the same time, the desirable properties in fixing property or charge property are obtained.

According to the present invention, a relation of methanol concentration and the transmittance, in other words, the wettability of the toner, in other words, the hydrophobic property of the toner, is measured using a methanol dropping transmittance curve. Specifically, as a measuring device, the wettability testing machine WET-100P of Resca Ltd., can be named. Measurement operation of the device is described concretely hereinbelow.

First of all, 70 ml of a mixed solvent of water and methanol comprising 40% by volume of methanol and 60% by volume of water is poured into a container. The solvent is dispersed for 5 minutes using the ultra sonic dispersing device in order to remove bubbles inside the measuring sample. 0.5 g of a toner as a sample is weighted precisely and added to the resultant solvent. Thus, a sample solvent for measuring a hydrophobic property of the toner is prepared.

Then, methanol is successively added at the dropping rate of 1.3 ml/min to the sample solvent agitated at a speed of 6.67 $s^{-1}$ (the rotating speed of magnetic stirrer), and the light transmittance is measured at the wavelength 780 nm, thereby creating a methanol dropping transmittance curve illustrated in the drawing of FIG. 1. The reason for using the methanol as titration solvent at this time is because various toner materials comprised in the toner particles such as dye, pigments, and charge control agents are unlikely to melt out from the toner particles and the surface condition of toner is more accurately measured. Now, upon this measurement, a glass beaker having cylindrical wall and a base, the base diameter of 5 cm and glass thickness of 1.75 mm was used. The magnetic stirrer tip used is spindle-shaped, and has a length of 25 mm and maximum diameter of 8 mm. The stirrer tip is coated using fluoride resin.

If the toner gets wet at the methanol concentration less than 40% by volume, then the toner is added to the solvent being mixed, and the optical transmittance at the wavelength 780 nm rapidly decreases close to 0% just by agitating the solvent.

The wettability of the toner is achieved by making the exposed conditions of toner materials at the surface of toner particles. The wettability of the toner is appropriately adjusted by controlling the disperseability of each material in the toner. Especially, in the present invention, by considering combinations of a polyester resin, a wax, and a colorant, the wettability of the toner may be controlled precisely.

As described previously, the end-offset is improved by increasing the affinity of toner for paper, and polyester resin is effective in preventing the charge-rise phenomenon. Specially, it is preferred to combine polyester resin and nonpolar wax that does not have acid group or hydroxyl group for improving the end-offset problem, especially to combine paraffin wax polyolefin wax, and Fischer-Tropsch wax.

These waxes having a small polarity show a large difference in polarity from a polarity of the polyester resin, such that phase separation speed of the waxes when the toner is melted by heat during fixing is fast. The wax emerges instantaneously to toner particle surface to strengthen the power of the toner attaching and sticking to the paper.

However, in order to uniformly disperse those waxes having a large polarity difference with a polarity of polyester resin in the toner particles, there is a need to select a production condition so that the waxes do not melt and re-agglomerate. It is important to set a kneading temperature of the toner low, disperse the waxes in the resin by applying strong pressure, and maintain the kneaded material temperature low.

In contrast to those conditions, in order to uniformly disperse components which are to be dispersed in the toner particles in particulate just like a colorant such as magnetic material, the preferred conditions are to set the kneading temperature high, and to perform kneading under the state of resin being softened due to melting. Especially, when using binder resin comprising a hard component such as THF insoluble component, the binder resin is softened by high temperature, and kneaded, so that the colorant such as magnetic material may be uniformly dispersed.

Since the wax having low polarity is readily and uniformly dispersed in the polyester resin by low temperature kneading, and because the colorant such as magnetic material is readily and uniformly dispersed by high temperature kneading, preferable mixing conditions are completely different. Thus, it becomes difficult to uniformly disperse the colorant such as magnetic material and the waxes to the toner particles that use polyester resin, and there is a need to consider the combination carefully bearing in mind the physical properties of various materials.

In the case of using the magnetic material as a colorant, the inventors found out the importance in controlling the wax solubility parameter (SP value) and isoelectric point of the magnetic material obtained from zeta potential in order to disperse the magnetic material and waxes having low polarity or non-polarity in the polyester resin in a substantially uniform condition.

In specific terms, in order to disperse non-polar wax and magnetic material in polyester resin in a substantially uniform condition, the preferable combination of hydrocarbon wax has the SP value of no more than 9 (preferably 7 to 9) and magnetic material having an isoelectric point of pH=5 to 9 (preferably in the range of 6 to 8). Since the polyester resin possesses much acidic groups to its molecular structure, the magnetic material existing inside the polyester resin is placed under the acidic environment upon kneading. The magnetic material having isoelectric point of the above-mentioned range, has a positive zeta potential upon kneading, and locally weakens the polarity of the polyester resin. Therefore, a difference of the polarity between the polyester resin and wax gets small, and a dispersibility of the wax is significantly improved.

As a result of this, it becomes possible to set the kneading condition so that it is beneficial to the dispersion of the magnetic material, and enable to cope with both a dispersion of the wax and a dispersion of the magnetic material to be performed at high level. Accordingly, each toner material is exposed at the surface of the toner particle in a substantially uniform condition, and it becomes possible to obtain a toner having preferable wettability for controlling image density lowering after being left to stand, the charge-rise, and the end-offset. Also, as the kneading temperature which is effective in dispersing the magnetic material may set high, when an aromatic hydroxycarboxylic acid compound which has aluminum is comprised in the toner particles, thermal cross linked reaction by kneading is liable to progress. It also becomes possible to comprise the THF insoluble component of an appropriate amount in the toner.

Figure 2:
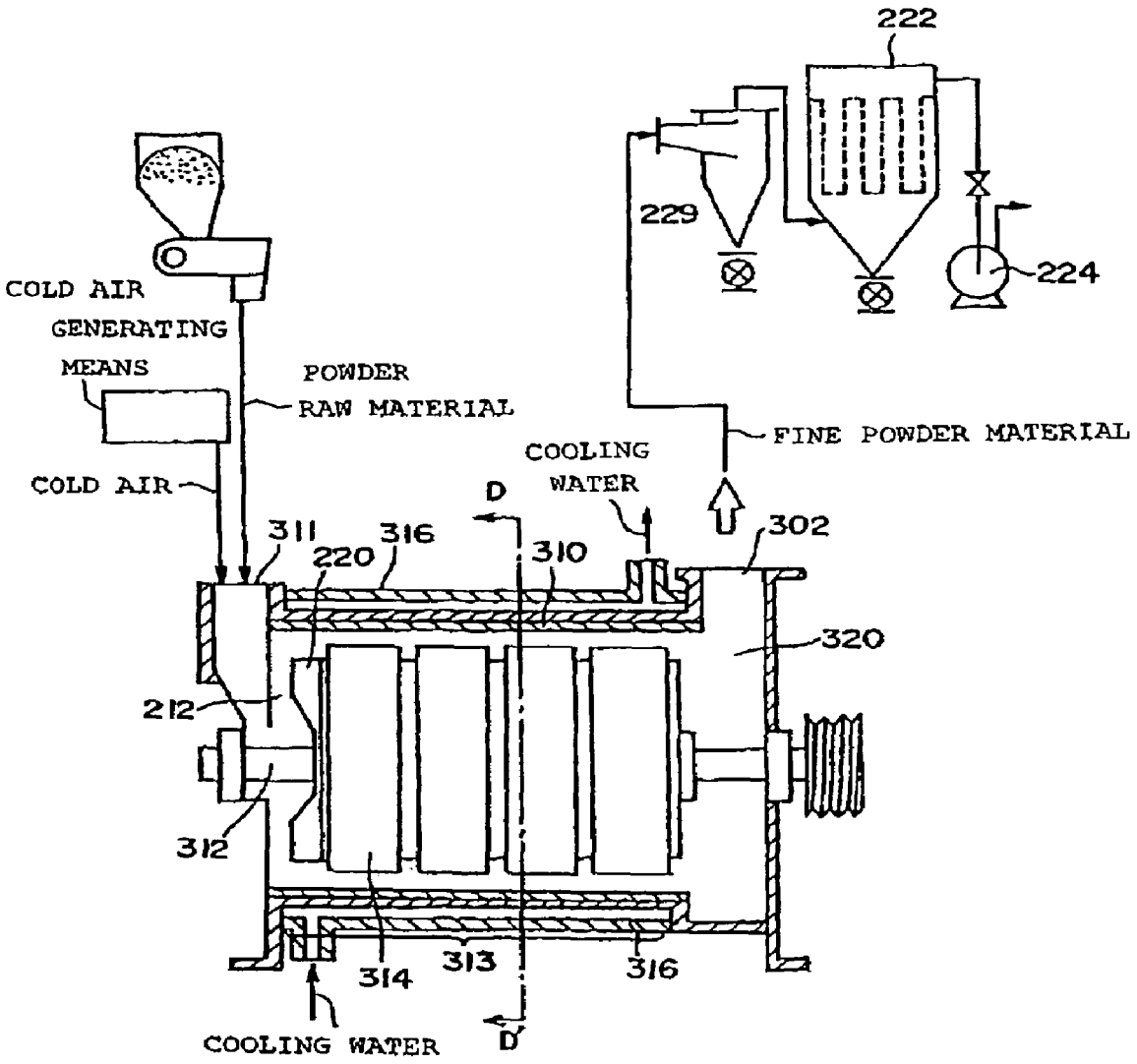
FIG. 2 is a partial cross section of mechanical pulverizer utilized in pulverizing process to produce a toner of the present invention.
Figure 3:
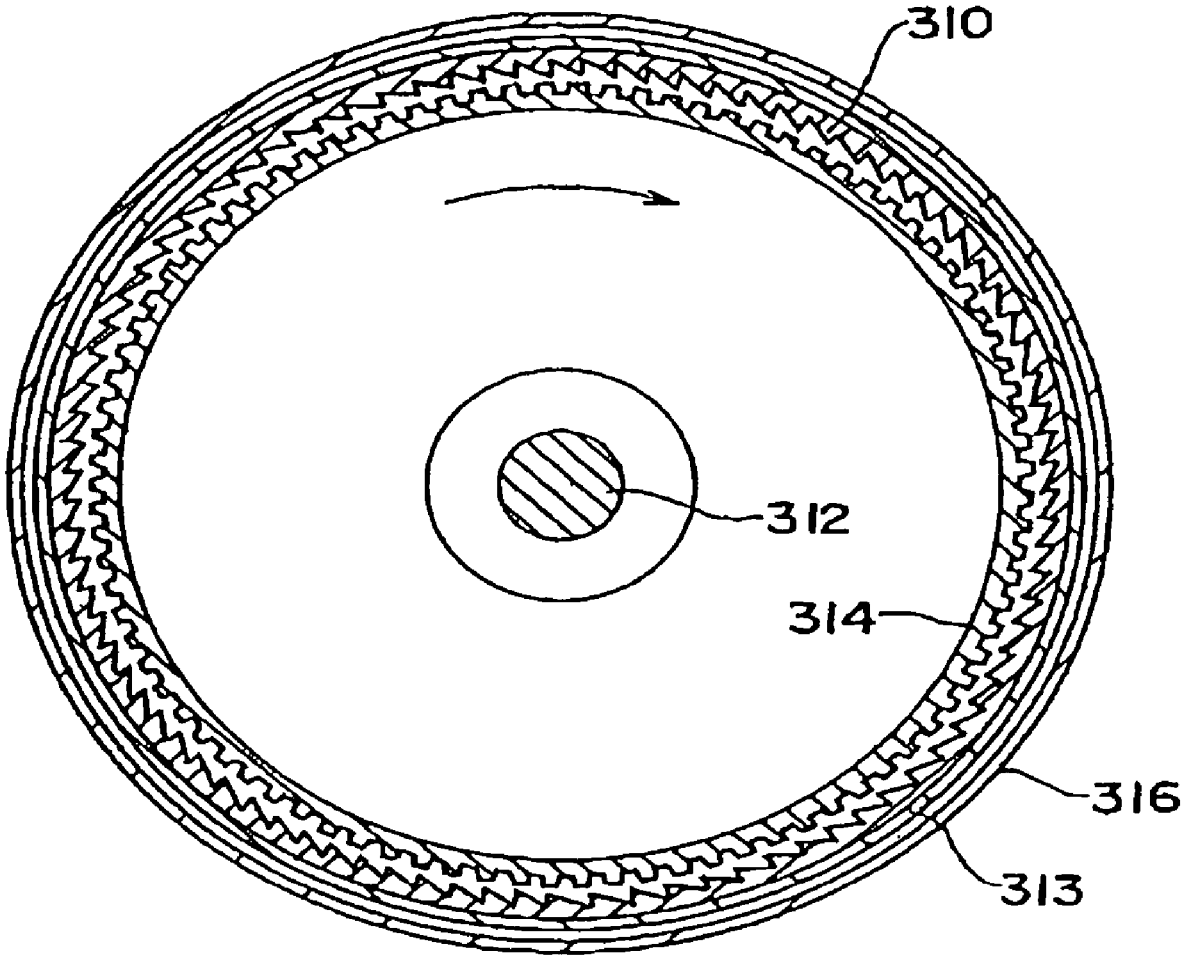
FIG. 3 is a cross section of plane D-D' of FIG. 2.
Figure 4:
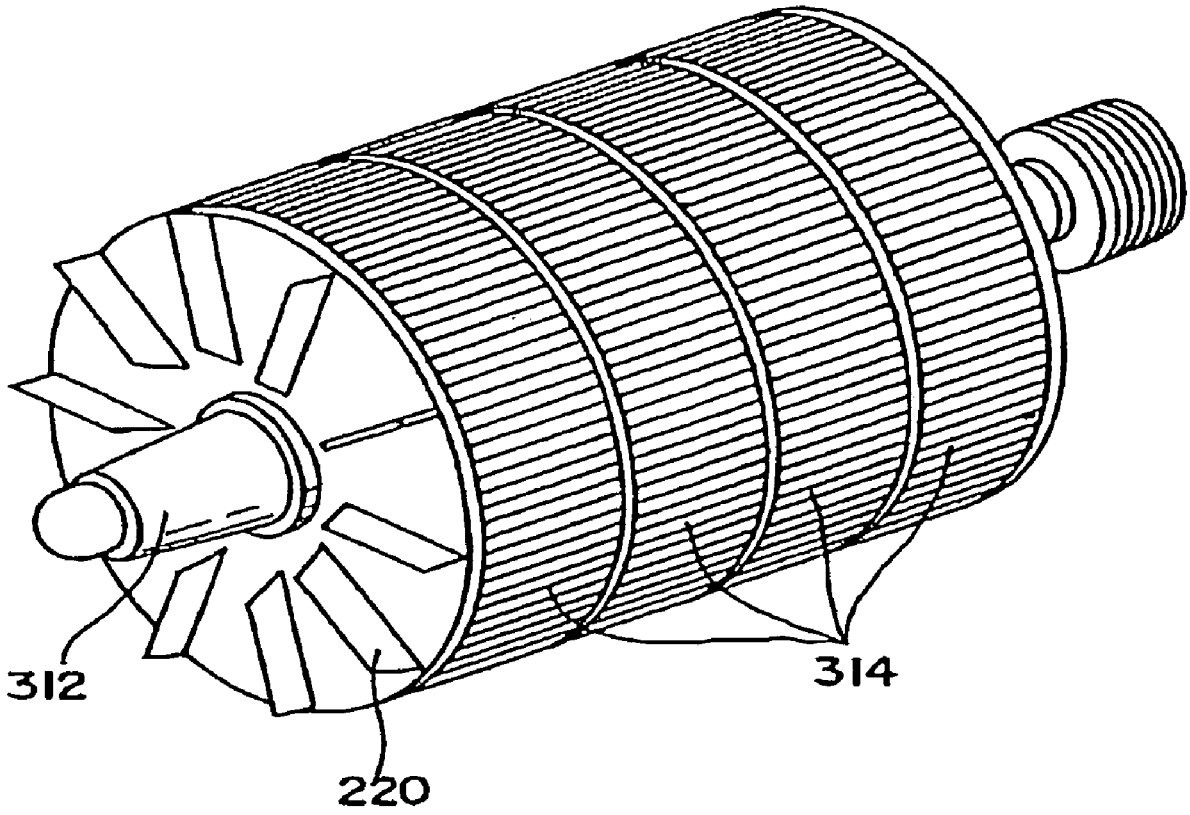
FIG. 4 shows an oblique view of a rotor of FIG. 2.

As one method for producing the toner, the mechanical pulverizer illustrated in the drawings of FIGS. 2, 3, and 4 is preferably used in the present invention. Since this pulverizer can carry out surface processing and pulverizing process of powdery raw material, efficiency may be improved. The pulverizer can more precisely control the surface condition of toner by adjusting the pulverizing temperature, by using magnetic material having isoelectric point of pH=5 to 9, by using wax having the SP value of no more than 9, by using polyester resin as the main component of binder resin, and by satisfying the condition of the MI of the toner, the amount of THF insoluble component, and the GPC chromatogram.

Hereinbelow, the mechanical pulverizer shall be described with reference to FIGS. 2, 3, and 4. FIG. 2 shows a partial cross section of mechanical pulverizer utilized in pulverizing process in toner production of the present invention. FIG. 3 shows a cross section of plane D-D' of FIG. 2. FIG. 4 shows an oblique view of the rotor 314 of FIG. 2.

Referring to FIG. 2, the mechanical pulverizer comprises a casing 313, a jacket 316, a distributor 220, a rotor 314 having a plurality of gutters at its surface which is a rotary member situated inside the casing 313 and mounted to a central rotation axis 312 and which rotates at high speed, a stator 310 having a plurality of gutters at its surface which is placed at a regular interval at a periphery of the rotor 314, a raw material inlet 311 for inducing the processed raw materials, and a material outlet 302 for expelling the powdery materials after a process. Now, the finely pulverized materials are collected by a pulverized material collecting device-having a collection cyclone, a bug-filter 222, and a suction blower 224.

Normally, when pulverizing a powdery raw material by using the mechanical pulverizer, temperatures T1 of a swirl room 212 and T2 of a back room 320 are controlled and pulverizing process is performed at temperature no more than Tg of the binder resin. In other words, the method for not improving the surface is selected. However, in order to obtain the toner of the present invention, the temperature of the outlet 302 is set less than the temperature Tg of binder resin by −25 to −5° C. During the actual pulverizing, the temperature is −20 to 0° C. less than the binder resin Tg. Thus, the pulverizing takes place that materials which expose on the surface of the toner particle and an exposure ratio of the materials is too large are crushed to surfaces of the stator and rotor to be contained within the toner particles. This way, the distribution of raw materials at the surface of the toner becomes liable to uniform, and the hydrophobic property of the toner is obtained, which is the feature of the present invention.

The toner of the present invention requires MI of the toner is in a range of 0.1 to 10 g/min (preferably 0.1 to 5 g/10 min) at a load of 5 kg and at 125° C. As long as the MI is in this range, the toner is in condition that a viscosity of a melting material obtained in a kneading process is suitable to uniformly disperse wax and magnetic material therein, so that a condition of the surface of the toner is easy to control. Further, the toner shows excellent characteristics regarding to end-offset and high temperature offset. In addition, the surface processing of toner particle by the mechanical pulverizer is effectively carried out, such that the wettability of the toner is easily controlled.

If the melt index MI of toner is smaller than 0.1 g/10 min, the viscosity of melting material upon kneading is too high, particularly, causing dispersion of magnetic material to easily deteriorate so that the magnetic material cannot be uniformly dispersed within the toner. In addition, even if the pulverizing condition is set as above, as the toner particles are too hard, it is hard to process the surface of the toner, and hydrophobic property, which is the feature of the present invention, cannot be obtained.

If the melt index MI of toner is greater than 10 g/10 min, because a viscosity of melting material during kneading is too high, causing deterioration of the dispersion of the wax, or a viscosity of toner is too low such that high temperature offset is deteriorated. Furthermore, under a condition where the end-offset occurs, high temperature offset is liable to occur at the same time, such that if the MI is greater than 10 g/10 min, the end-offset problem has not been solved even if the hydrophobic property is satisfactory.

The toner of the present invention comprises tetrahydrofuran (THF) insoluble component of 5 to 40% by mass (preferably 10 to 30% by mass) at the binder resin standard. In addition, according to a chromatogram that measures the THF soluble component of the toner using the gel permeation chromatography (GPC) shows a main peak at the molecular weight region ranging from 3,000 to 20,000. In addition, components having a molecular weight of no more than 10,000 must be comprised by more than 50% by mass in the THF soluble component.

Now, the previously mentioned tetrahydrofuran (THF) insoluble component is a resin component insoluble to tetrahydrofuran among the components contained in the toner particle. Examples of a toner material not corresponding to the resin component among components insoluble to THF includes, wax, a charge control agent, a magnetic material, and colorant such as a pigment, and an external additive such as inorganic fine powder. The amount of these components contained in the toner is obtained by measuring the ash component or by calculating the contained amount of the components, and these components are separated from the THF insoluble component of the present invention.

The toner of the present invention comprises the THF insoluble component of 5 to 40% by mass, and 50% by mass or more of component no more than 10,000 in molecular weight in the THF soluble component. For this reason, low molecular weight component having a low melting viscosity and high molecular weight component having a high melting viscosity are comprised by a predetermined amount, respectively. Thus, change of toner melting viscosity in response to temperature fluctuation during kneading is small and a predetermined kneading share is added to the kneading material. Accordingly, the dispersibility of raw material such as wax and magnetic material improves, thereby the hydrophobic property of toner be is controlled easily. As a result of this, the end-offset problem and the charge-rise problem are improved. In addition, such a binder resin has a wide molecular weight distribution, so that it becomes possible to achieve both excellent fixing property and excellent high temperature offset property.

Furthermore, according to the toner of the present invention, when the molecular weight of the peak top of the main peak exits in the range of 3,000 to 20,000, the mechanical strength of toner increases, and excessive pulverizing is prevented, therefore surface processing of toner upon pulverizing is appropriately carried out, thus a desirable hydrophobic property of the toner may be obtained.

If the THF insoluble component of the toner is less than 5% by mass, the melting viscosity during kneading gets too low, and dispersion of wax is deteriorated, and it is difficult to control hydrophobic property of the toner, or the mechanical strength of toner decreases, and the toner is readily deteriorated due to load inside the developer device, or a developing durability of the toner maybe degraded. If the THF insoluble component of the toner is greater than 40% by mass, the load during kneading is large, and dispersion property of the material is deteriorated so that the desired hydrophobic property cannot be obtained, the developing performance is deteriorated, and the fixing property may be lowered.

If the molecular weight of the peak top is less than 3,000, the mechanical strength of the toner decreases, so that excessive pulverizing is liable to occur, the wettability of the toner against the mixed solvent of methanol and water is difficult to be controlled, and the end-offset and the charge-rise cannot be prevented. Furthermore, the developing durability of toner may decrease. If the molecular weight of the peak top is more than 20,000, the pulverizing property is deteriorated, and the toner with desirable particle diameter is not obtained, or the amount of heat generated during pulverizing becomes too large such that surface processing of toner may be not appropriately carried out. In addition, the melting viscosity during kneading gets too high and dispersing of colorant and fixing property may deteriorate.

In addition, if the amount of component of molecular weight no more than 10,000 comprised in the THF soluble component is less than 50% by mass, the melting viscosity of kneading material gets high, and dispersion of the colorant is deteriorated, and the hydrophobic property of toner may not be controlled.

Now, the proportion of component of molecular weight no more than 10,000 of THF soluble component and the area that the main peak exists in GPC, a content of the THF insoluble component, and MI of the toner is appropriately adjusted according to the manufacturing condition of the toner, contents or types of material comprising the toner particle (for instance, binder resin and charge controlling agent).

The toner of the present invention comprises the THF soluble component which has greater than 200,000 (preferably 500,000) weight average molecular weight (Mw) to be preferable in improving the developing durability and increasing the mechanical strength of the toner.

Furthermore, according to the toner of the present invention, based on the chromatograph that measures THF soluble component measured by using GPC, it is preferred that the ratio of the weight average molecular weight (Mw) and number average molecular weight (Mn), namely Mw/Mn, is 20 or more (preferably 50 or more). It is more preferred that the ratio of the z average molecular weight (Mz) and the weight average molecular weight (Mw), namely (Mz/Mw), is 30 or more (preferably 50 or more). These ratios are preferable in obtaining excellent high temperature offset property and excellent fixing property. Now, regarding to the various average molecular weights mentioned previously, those are appropriately adjusted based on the contents or the types of the materials of the toner being used, and adjustment of degree of polymerization of the binder resin.

The toner of the present invention comprises of the binder resin comprising polyester resin as the main component, however, as the other resin component, well-known resins such as vinyl compounded resin or hybrid resin may also be included. According to the present invention, the term "comprising polyester resin as the main component" indicates that 50% by mass or more of the binder resin is polyester resin.

It is preferable that the polyester resin used in the present invention has a molecular weight of the main peak of the THF soluble component in the range of 3,000 to 20,000, and comprises the low molecular weight polyester component comprising 0 or 3% by mass of THF insoluble component and cross-linked polyester comprising 10 to 60% by mass of THF insoluble component. In addition, the preferable ratio of cross-linking polyester component and low molecular weight polyester component is 10:90 to 90:10. The ratio of 30:70 to 70:30 is preferred, and more preferably, the ratio of 40:60 to 60:40.

Under such ratio, by mixing low molecular weight polyester component together with cross-linked polyester component, it becomes possible to obtain an amount of the THF insoluble component and molecular weight distribution which are difficult to achieve with solely a polyester component, and therefore, dispersion of colorant and wax is easily controllable. Thus, hydrophobic property, fixing property, high temperature offset property, and developing performance are easily balanced. If ratio of the low molecular weight polyester component increases than that mentioned above, the dispersibility of the wax becomes worse such that the desired hydrophobic property cannot be obtained, and resistance to high temperature offset property and developing durability may be deteriorated. If the ratio of the low molecular weight polyester component decreases, fixing property at a low temperature and a dispersion of colorant may be deteriorated.

Furthermore, the cross-linked polyester component preferably comprises polyhydric alcohol with 3 or more hydroxyl groups and polycarboxylic acid with 3 or more carboxyl groups as its monomer component.

Polyhydric alcohol and polycarboxylic acid with 3 or more groups are mainly used to allow the polyester to have cross-linked component, however, by using the component with 3 or more groups as both acid component and alcohol component, the acid value and hydroxyl value are well-balanced, and the wettability of the toner is easily controlled, and end-offset and charge-rise problems are improved.

Furthermore, in the present invention, when the polyhydric alcohol with 3 or more hydroxyl group is an oxyalkylene ether of novolak type phenolic resin, and the polycarboxylic acid with 3 or more carboxyl groups is trimellitic acid or trimellitic anhydride, it is preferred in order to improve the high temperature offset without degrading the fixing property.

When oxyalkylene ether of novolak type phenolic resin is used, a flexible cross linked material is obtained. The cross linked material has extremely large molecular weight, spaces between the crosslinking points of the cross linked material are long (molecular weight of components between the crosslinking points is large), and molecular movement by heat is formed easily in the cross linked material. Such cross-linked component readily incorporates therein the low molecular polyester component, and softens due to heat. Further, since the molecular weight is extremely large, the viscosity does not decrease more than necessary. Accordingly, it is preferred in terms of improving the high temperature offset property without inhibiting the fixing property.

In addition, when trimellitic acid or trimellitic anhydride are used as the polycarboxylic acid with 3 or more carboxyl groups, if aromatic hydroxycarboxylic acid compound with aluminum is comprised, the cross linked reaction is liable to be caused by heat during kneading, enabling THF insoluble component of toner to be supplemented, which is decreased by cut-off during kneading. Therefore use of trimellitic acid or trimellitic anhydride is preferable.

The preferable polyester resin used in the present invention has acid value ranging from 5 to 40 mgKOH/g and hydroxyl value in the range of 10 to 50 mgKOH/g.

If the acid value is less than 5 mgKOH/g or if the hydroxyl value is less than 10 mgKOH/g, it is hard that the toner wets with respect to mixed solvent of methanol and water, and thus is liable to be increased in the hydrophobicity, causing deterioration of end-offset and charge-rise in some cases.

If the acid value is more than 40 mgKOH/g, and if the hydroxyl value is greater than 50 mgKOH/g, the hydrophobicity of toner is lieble to get small, and there is a possibility that image density after the toner being left standing under high temperature and high humidity environment is significantly lowered. In addition, if the acid value is too high, even if the isoelectric point of magnetic material is controlled, the force of weakening the polarity of polyester resin is not sufficient, and it is difficult to obtain an effect of the dispersion of the wax.

In the cross-linking polyester component used in the present invention, it is preferred that a MI of the cross-linking polyester component is in a range of 0.1 to 10 g/10 min (preferably 0.1 to 5 g/10 min, or more preferably 0.3 to 3 g/10 min) at load 10 kg and temperature 190° C., to satisfy developing property, fixing property, high temperature offset, end-offset at higher level.

If the MI of the cross linked polyester component is less than 0.1 g/10 min, the melting viscosity of the cross linking polyester component is too high, and the difference in the melting viscosity with the low molecular weight polyester component gets large, and it becomes difficult to uniformly mix the low molecular weight polyester component and cross linked polyester component by melting and kneading when forming toner.

As a result of this, the ratio of cross linking polyester component per toner particle and low molecular weight polyester component, and dispersion condition of raw material such as wax and colorant are liable to get non-uniform, and fluctuation in a wettability with respect to the mixed solvent of methanol and water per each toner particle gets large, and it becomes difficult to control to make the methanol concentration in a range of 45 to 65% by volume when the transmittance are 80% and 10%.

As a result of this, toner particles having non-uniform wettability a reliable to be obtained, and charge-rise or end-offset may be deteriorated, or the fixing property may be deteriorated. If the MI of crosslinked polyester component is more than 10 g/10 min, the high temperature offset may be deteriorated, and melting viscosity and kneading gets too low, and the dispersion of the wax may be deteriorated.

Examples of the monomer component comprising the polyester resins used in the present invention include the following compounds.

Examples of dihydric alcohol components include: ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, bisphenols represented by the following formula (A) and derivatives thereof; and diols represented by the following formula (B).

(A)

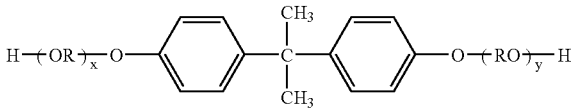

(In the formula, R denotes ethylene group or propylene group, x and y denote integer of 0 or more, respectively, and x+y denotes an average value from 0 to 10.)

(B)

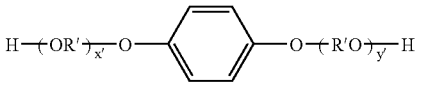

(In the formula, R' denotes one or more two of alkyl groups represented by the following formulas, x' and y' denote integer of 0 or more, and x'+y' denotes an average value from 0 to 10.)

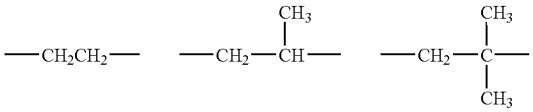

Examples of divalent acid components include: benzenedicarboxylic acids or anhydrides thereof or lower alkyl esters thereof such as phthalic acid, terephthalic acid, isophthalic acid, and phthalic anhydride; alkyldicarboxylic acids such as succinic acid, adipic acid, sebacic acid, and azelaic acid, or anhydrides thereof or lower alkyl esters thereof; alkenyl succinic acids or alkyl succinic acids, such as n-dodecenylsuccinic acid and n-dodecylsuccinic acid, or anhydrides thereof or lower alkyl esters thereof; and unsaturated dicarboxylic acids such as fumaric acid, maleic acid, citraconic acid, and itaconic acid, or anhydrides thereof or lower alkyl esters thereof.

Further, in the present invention, as mentioned above, it is preferable to combine an alcohol component with 3 or more hydroxyl groups and an acid component with 3 or more carboxyl groups to act as across-linking component. Examples of a polyhydric alcohol component with 3 or more hydroxyl groups include: sorbitol; 1,2,3,6-hexanetetrol; 1,4-sorbitan; pentaerythritol; dipentaerythritol; tripentaerythritol; 1,2,4-butanetriol; 1,2,5-pentanetriol; glycerol; 2-methylpropanetriol; 2-methyl-1,2,4-butanetriol; trimethylolethane; trimethylolpropane; and 1,3,5-trihydroxybenzene. As a particularly preferable polyhydric alcohol component with 3 or more hydroxyl groups, oxyalkylene ester of novolac type phenol resin can be given.

oxyalkylene ether of novolak type phenolic resin includes the novolak type phenolic resin and a compound having one epoxy ring in the molecular structure react and bond by ether linkages.

As the novolak type phenolic resin, for example, as sited in Encyclopedia of Polymer Science and Technology (Interscience Publishers) volume 10, page 1, section on phenolic resins, the resin is manufactured by poly condensation of phenols and aldehydes using metallic salt such as zinc acetate, or organic acid such as para-tuluene sulfonic acid and oxalic acid, or inorganic acid such as phosphoric acid, sulfuric acid and hydrochloric acid as catalysts.

As the above mentioned phenols, phenol and a substituted phenol having one or more substituents selected from hydrocarbon groups with the carbon number of 1 to 35 or halogen groups are given. Specific examples of the substituted phenol include cresol (any one of ortho-, meth- and para-), ethylphenol, nonylphenol, octylphenol, phenylphenol, styrenated phenol, isopropenylphenol, 3-chlorophenol, 3-bromphenol, 3,5-xylenol, 2,4-xylenol, 2,6-xylenol, 3,5-dichlorophenol, 2,4-dichlorophenol, 3-chloro-5-methylphenol, dichloroxylenol, dibromxylenol, 2,4,5-trichlorophenol, and 6-phenyl-2-chlorophenol. Two or more of the phenols may also be combined.

Of those, substituted phenol replaced by phenol and hydrocarbon group is preferable, particularly, phenol, cresol, t-butylphenol, and nonylphenol are preferred. Phenol and cresol are preferable in terms of cost and giving anti offset property of toner. The substituted phenol replaced by hydrocarbon group, typically t-butylphenol or nonylphenol, is preferable since temperature dependency property of charge amount of toner is made small.

Examples of the aldehydes include formalin (various concentrations of formaldehyde solutions), paraformaldehyde, trioxane, and hexamethylenetetramine.

Average of number of Phenols inside the novolak type phenol resin is 3 to 60, or preferably 3 to 20, or more preferably 4 to 15. In addition, the softening point (JISK 7231; ring and ball method) is normally 40 to 180° C., or preferably 40 to 150° C., or more preferably 50 to 130° C. If the softening point is below 40° C., blocking may cause at normal temperature it may be difficult to treat. In addition, if the softening point exceeds 180° C., gelification may occur during manufacturing process of the polyester resin, which is not preferable.

Examples of a compound having a single epoxy ring in the molecular structure includes ethylene oxide (EO), 1,2-propylene oxide (PO), 1,2-butylene oxide, 2,3-butylene oxide, styrene oxide, and epichlorohydrin. Also, fatty acid monohydric alcohol having carbon number 1 to 20 or glycidyl ether of monohydric phenol can be used. Among those, EO and/or PO are preferred.

An attached mole number of compound having one epoxy ring inside the molecular structure is normally 1 to 30 moles, or preferably 2 to 15 moles, and more preferably 2.5 to 10 moles for every 1 mole of novolak type phenolic resin. In addition, the average attached mole number of compound having one epoxy ring inside the molecule structure regarding to one phenolic hydroxyl group inside the novolak type phenolic resin is normally 0.1 to 10 moles, or preferably 0.1 to 4 moles, and more preferably 0.2 to 2 moles.

Chemical structure of oxyalkylene ether of the novolak type phenol resin preferably being used in the present invention is illustrated below.

(C)

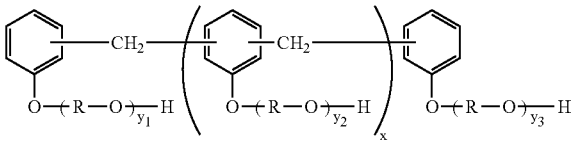

(In the formula, R denotes ethylene group or propylene group, x denotes integer 0 or more, and y1, y2, and y3 denote the same or different integer of 0 or more. Each of y2 may be the same or different value when x is 2 or more.)

Number average molecular weight of oxyalkylene ether of novolak type phenolic resin is normally 300 to 10,000, or preferably 350 to 5000, or more preferably 450 to 3,000. If the number average molecular weight is less than 300, the anti offset property of toner may be insufficient. If the number average molecular weight exceeds 10,000, gelification may result during the manufacturing process of the polyester resin, which is not preferable.

Hydroxyl value of oxyalkylene ether of novolak type phenol resin (a total of phenol hydroxyl group and alcohol hydroxyl group) is normally 10 to 550 mgKOH/g, or preferably 50 to 500 mgKOH/g, or more preferably 100 to 450 mgKOH/g. In addition, among the hydroxyl value, the phenol hydroxyl value is normally 0 to 500 mgKOH/g, or preferably 0 to 350 mgKOH/g, or more preferably 5 to 250 mgKOH/g.

To illustrate the manufacturing procedure of oxyalkylene ether of novolak type phenolic resin, under the presence of catalyst (basicity catalyst or acidic catalyst) as required, a compound having a single epoxy ring inside the molecule structure is additionally reacted to novolak type phenolic resin to obtain oxyalkylene ether of novolak type phenolic resin. A reaction temperature is normally 20 to 250° C., or preferably 70 to 200° C. This is performed under normal pressure, extra pressure, or reduced pressure. Also, the reaction is carried out under the presence of a solvent (such as xylene and dimethylformamide) or other dihydric alcohol or other alcohol with more than 3 hydroxyl groups.

Further, examples of a polycarboxylic acid component with 3 or more carboxyl groups as the monomer component comprising polyester resins used in the present invention include, polycarboxylic acids and derivatives thereof such as: pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra(methylenecarboxyl)methane, 1,2,7,8-octanetetracarboxylic acid, empol-trimer acid, anhydrides thereof and lower alkyl esters thereof; and tetracarboxylic acids represented by the following formula, anhydrides thereof, and lower alkyl esters thereof. Of those, 1,2,4-benzenetricarboxylic acid, 1,2,5-benzenetricarboxylic acid, anhydrides thereof, and lower alkyl esters thereof are preferable.

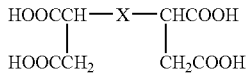

(In the equation, X denotes alkylene group or alkenylen group having carbon number of 5 to 30 having more than one side chain with carbon number of three or more.)

Regarding to a proportion of components inside the polyester resin utilized in the present invention, the preferable proportion of the alcohol is 40 to 60 mol %, or more preferably 45 to 55 mol %. Also, the proportion of the acid component is preferably 60 to 40 mol %, or more preferably 55 to 45 mol %. Polycomponent with more than three groups is preferably comprising 5 to 60 mol % of the all of the above-mentioned composition in a total amount.

Polyester resin is obtained by condensation polymerization which is well-known in general. Temperature condition of polymerization reaction of polyester resin is 150 to 300° C. under the presence of catalyst normally, or preferably 170 to 280° C. Also, the reaction is carried out under normal pressure, reduced pressure, or extra pressure. The reaction is desirably carried out by reducing reaction system pressure to no more than 200 mmHg, or preferably no more than 25 mmHg, or more preferably no more than 10 mmHg after a predetermined rate of reaction is achieved (for instance, about 30 to 90%).

Examples of the above-mentioned catalyst include catalysts that are normally used in polyesterification such as: metals such as tin, titanium, antimony, manganese, nickel, zinc, lead, iron, magnesium, calcium, and germanium; and compounds containing those metals (such as dibutyltin oxide, ortho dibutyl titanate, tetradibutyl titanate, zinc acetate, lead acetate, cobalt acetate, sodium acetate, and antimony trioxide). When a property of a reactant (such as an acid value and a softening point) has reached a predetermined value, or when the agitation torque or agitation power of a reaction machine has reached a predetermined value, the reaction is terminated so that physical properties of the obtained polyester resin are adjusted.

Furthermore, the toner of the present invention comprises colorant. Various kinds of well-known colorants can be used in the present invention responding to the types of toner.

Furthermore, the toner of the present invention is preferably magnetic toner. The content of a magnetic material inside the toner is 30 to 200 parts by mass (preferably 50 to 150 parts by mass) in every 100 parts by mass of a binder resin. In this case, the magnetic material can also double as a colorant. The magnetic material is uniformly dispersed inside the toner particle, and the magnetic material is exposed to the surface of the toner particle appropriately, and the toner charge is stabilized, so that the toner is especially effective in controlling the charge-rise.

As the magnetic material particularly preferably used in the present invention, one having an isoelectric point in a range of pH=5 to 9 (preferably 6 to 8) worked out from the zeta potential may be given. If the isoelectric point of the magnetic material is in this range, the zeta potential of the magnetic material in the acidic region shows a positive value. Thus, when a polyester resin having an acid value and the magnetic material are melted and mixed, the magnetic material is likely to carry a positive potential in the kneaded material. As a result of this, the polarity of a polyester resin existing near the magnetic material is locally weakened, and the wax having a large difference in polarity from the polyester resin is easily dispersed, and the kneading condition can be set advantageous to the magnetic material dispersion.

If the isoelectric point is less than ph=5, the zeta potential of the magnetic material in the acidic region becomes small, or turns negative. The force of weakening the polarity of the polyester resin gets small, and dispersion of the wax may become worse. If the isoelectric point is more than pH=9, the magnetic material absorbs more moisture, such that the hydrophobic property of toner may be lowered, or a decline in image density may be enlarged after the toner is left to stand under a high humidity environment.

The isoelectric point of the magnetic material is worked out from the zeta potential. The zeta potential can be measured using DT-1200 (manufactured by Dispersion Technology Ltd.), for example. The magnetic material is dispersed in a 0.01 mol/liter $KNO_3$ solution in a concentration of 5% by mass. A graph showing variation in zeta potential with pH is drawn. The isoelectric point is calculated based on this graph. Note that the isoelectric point is the pH value at which the zeta potential is 0.

Examples of the magnetic material used in the present invention include: iron oxides such as magnetite, maghemite, and ferrite; and metals such as iron, cobalt, and nickel, or alloys thereof with metals such as aluminum, cobalt, copper, lead, magnesium, manganese, selenium, titanium, tungsten, and vanadium, and mixtures thereof. A magnetic material containing a non ferrous element on the surface or in the interior thereof is preferable.

As the magnetic material to be used in the present invention, a magnetic iron oxide such as magnetite, maghemite, or ferrite with a hetero-element, or a mixture thereof is preferably used. Especially, preferably used is a magnetic iron oxide containing at least one element chosen from lithium, beryllium, boron, magnesium, aluminum, silicon, phosphorus, germanium, titanium, zirconium, tin, lead, zinc, calcium, barium, scandium, vanadium, chromium, manganese, cobalt, copper, nickel, gallium, cadmium, indium, silver, palladium, gold, mercury, platinum, tungsten, molybdenum, niobium, osmium, strontium, yttrium, technetium, ruthenium, rhodium, and bismuth. Specifically, lithium, beryllium, boron, magnesium, aluminum, silicon, phosphorus, germanium, zirconium, tin, and fourth period transition metal elements are preferable elements.

Those elements can be incorporated within an iron oxide crystal lattice, or may be incorporated in iron oxide as oxides, or can exist at a surface of iron oxide as hydroxides or oxides. However the most preferred form is to be incorporated as oxides.

Especially, it is preferable that one or more type of element selected from the group consisting of magnesium, copper, zinc, and titanium and silicon are present at the magnetic iron oxide surface, and furthermore, it is preferable that an aluminum element is present at the outermost surface of such magnetic iron oxide in order to control the zeta potential of the magnetic material.

The isoelectric point of the magnetic iron oxide is prepared based on composition or a surface condition of the magnetic iron oxide surface such as a manufacturing condition including pH, an amount of an attached metallic element, and an extent of exposure of the attached metallic element to the magnetic iron oxide surface.

The magnetic iron oxide used in the present invention can be produced by appropriately adjusting the pH inside the reaction system when producing a normal magnetic iron oxide using a suitable salt containing a silicon element, and a suitable salt containing one or more of the four elements, that is, magnesium, copper, zinc, and titanium. Hereinbelow, a method for manufacturing of the magnetic iron oxide used in the present invention in the case of using zinc as the element will be described.

The magnetic iron oxide related to the present invention is prepared by adding a predetermined amount of a metallic salt, silicate, or the like of Zn to a ferrous salt aqueous solution, and adding an equivalent amount or more of an alkali such as sodium hydroxide to an iron component, and preparing an aqueous solution containing ferrous hydroxide. The air is blown in the prepared aqueous solution while the pH of the solution is maintained to pH=7 or higher (preferably pH=8 to 10), followed by an oxidation reaction of ferrous hydroxide by heating the aqueous solution to a temperature of 70° C. or more. A seed crystal which is a core of the magnetic iron oxide particle is formed.

Next, an aqueous solution containing one equivalent of ferrous sulfate is added to a slurry liquid containing the seed crystal, with the amount of the previously added alkali as the standard. After that, pH of the liquid is maintained from 6 to 10. The air is blown in the liquid to progress the reaction of ferrous hydroxide, and the magnetic iron oxide particle is grown around the seed crystal core.

At this time, by combining pH adjustment and progress of the oxidation reaction and by progressing the reaction stepwise, for example, with pH of 9 to 10 at the initial stage of the reaction, and with pH of 8 to 9 at the middle stage of reaction, and with pH of 6 to 8 at the end stage of reaction, the composition ratio of the surface of the magnetic iron oxide is controlled. Thus, the isoelectric point of the magnetic iron oxide is easily controlled. In addition, as the oxidation reaction proceeds, the pH of the solution shifts to the acidic side, however, pH of the solution is controlled so that the pH does not go less than 6.

Following on, in the case of treating with aluminum hydroxide so that the aluminum element exist on the outermost surface, a water-soluble aluminum salt is added to the alkalescence suspension (where magnetic iron oxide particles containing silicon elements are produced) in an amount of 0.01 to 2.0% by mass, in aluminum element equivalent, with respect to the producing particle, and after that the pH of the mixture is adjusted to the range of 6 to 8 to precipitate the water-soluble aluminum salt as aluminum hydroxide at the surface of the magnetic iron oxide.

After filtering, washing, drying, and pulverizing are performed, the magnetic iron oxide having aluminum hydroxide is obtained. Furthermore, as a method for preferably adjusting the degree of smoothness and the specific surface area, a mix marler or a mixer is preferably used to compress, shear, and flatten the magnetic iron oxide using spatula.

Examples of the metallic salts to be added, using elements other than iron include sulfates, nitrates, and chlorides. In addition, examples of silicates to be added include sodium silicate and potassium silicate.

As a ferrous salt, it is possible to use a by product ferrous sulfate, which is generally produced in association with the production of titanium by the sulfuric acid method. Furthermore, a ferrous salt produced by washing the surface of copper sheet is also usable. Ferrous chloride, or the like is also usable.

According to the method for manufacturing magnetic iron oxide by using the aqueous solution method, in general, in view of prevention of an increase in the viscosity during reaction, and the solubility of the ferrous sulfate, the iron salt to be used has an iron concentration of 0.5 to 2 mol/liter. The granularity of the product gets finer if the concentration of the ferrous sulfate is lower. Regarding to the reaction, the granularity gets finer if the air is abundant and if a reaction temperature is lower.

In addition, the magnetic material used in the toner of the present invention may be processed by silane coupling agent, titanate coupling agent, and the like.

As a colorant that can be used in the toner of the present invention other than the previously described magnetic material, suitable pigments and dyes are used arbitrarily. Examples of the pigments are: carbon black, aniline black, acetylene black, naphthol yellow, hansa yellow, rhodamine lake, alizarin lake, red iron oxide, phthalocyanine blue, and indanthrene blue.

When using a material other than the magnetic material as the colorant, then an amount enough to maintain an optical density of a fixed image must be used. The amount of the colorant to be added is 0.1 to 20 parts by mass, or preferably 0.2 to 10 parts by mass for every 100 parts by mass of the binder resin. For the likewise purpose, the dye is additionally used. Examples of the dye include azo dye, anthraquinone dye, xanthene dye, and methine dye. An amount of the dye to be added is 0.1 to 20 parts by mass, or preferably 0.3 to 10 parts by mass for every 100 parts by mass of the binder resin.

In the present invention, in order to obtain better stability of the charge property, 0.1 to 15 parts by mass (more preferably 0.1 to 10 parts by mass) of the metallic compound as the charge control agent is added to the toner particles (inside additive), or mixed with the toner particles (external additive), for every 100 parts by mass of the binder resin. The charge control agent makes it possible to readily-control the optimum amount of charge depending on the development system.

Examples of the compounds effective for controlling the negative charge of the toner include organometallic compounds, and chelate compounds. For instance, monoazo metal compounds, acetylacetone metal compounds, and metallic compounds such as an aromatic hydroxycarboxylic acid type and an aromatic dicarboxylic acid type can be given. Other examples include: aromatic hydrocarboxylic acids, aromatic monocarboxylic acids, aromatic polycarboxylic acids and their metallic salts, their anhydrides, and their esters; and phenol derivatives such as bisphenol.

A positively-charged charge control agent can be used in the toner of the present invention as required. Examples of compounds for controlling the positive charge of the toner include: reforming materials by such as nigrosine and fatty acid metallic salts; quaternary ammonium salts such as tributylbenzylammonium-1-hydroxy-4-naphthalenesulphonate and tetrabutylammonium-tetrafluoroborate, and their analogues such as onium salt such as phosphonium salt and their lake pigment, and triphenylmethane dye and their lake color (a lake former thereof includes phosphotungstic acid, phosphomolybdic acid, phosphotungsten molybdic acid, tannic acid, lauric acid, gallic acid, ferricyanides, and ferrocyanides), metallic salts of high grade fatty acids; diorganotin oxide such as dibutyltin oxide, dioctyltin oxide, and dicyclohexyltin oxide; diorganotin borates such as dibytultin borate, dioctyltin borate, and dicyclohexyltin borate; guanidine compounds, and imidazole compounds. These can be used solely or in combination of two kinds or more.

Of those compounds, triphenylmethane compounds and quaternary ammonium salts where the counter ion is not halogen, are preferably used. In addition, a homopolymer of the monomer expressed in the general formula (1) shown below and a copolymer thereof with a polymerizable monomer such as styrene, acrylicester, and methacrylic acid ester can be used as the positively-charged charge control agent. These can constitute partially or fully the structure of the binder resin.

(1)

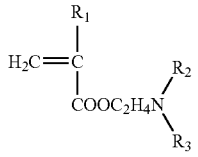

(In this chemical formula, $R_1$ denotes H or $CH_3$, $R_2$ and $R_3$ denote a substituted or unsubstituted alkyl group (preferably C1 to C4.))

A compound shown in the general formula (2) below is particularly preferred as the positively charged charge control agent.

(2)

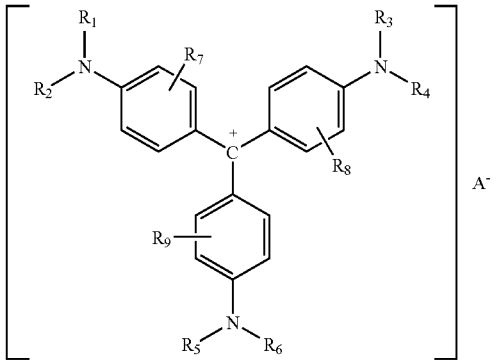

(In this chemical formula, $R_1$, $R_2$, $R_3$, $R_4$, $R_5$, and $R_6$ denote one or more selected from a hydrogen atom, a substituted or unsubstituted alkyl group, and a substituted or unsubstituted aryl group (can be identical to or different from one another); $R_7$, $R_8$, and $R_9$ denote one or more selected from a hydrogen atom, a halogen atom, an alkyl group, and an alkoxyl group (can be identical or different from one another). $A^-$ denotes an anion selected from a sulfate ion, a nitrate ion, a borate ion, a phosphate ion, a hydroxyl ion, an organic sulfate ion, an organic sulfonic acid ion, an organic phosphate ion, a carboxylic acid ion, an organic borate ion, and tetrafluoroborate.

The charge control agent described above is preferably used as fine powders.

In the present invention, an aromatic hydroxycarboxylic acid compound with aluminum and a monoazo iron compound are preferably used jointly. The aromatic hydroxycarboxylic acid compound with aluminum can synthesize THF insoluble components by a cross-linked reaction with a polycarboxylic acid in the polyester resin during kneading. The monoazo iron compound can maintain stable charge for a prolonged endurance, and is effective in preventing the charge-rise phenomenon and also in preventing a decline in image density after neglect under a high humidity environment.

Under such circumstances, a preferred amount of the aromatic hydroxycarboxylic acid compound with aluminum is 0.1 to 5 parts by mass for every 100 parts by mass of the binder resin. A preferred amount of the monoazo iron compound is 0.1 to 10 parts by mass for every 100 parts by mass of the binder resin.

The examples of hydroxycarboxylic acids (I), (II), and (III) and azo compounds (IV) and (V) preferably used in the present invention are illustrated below.

(I)

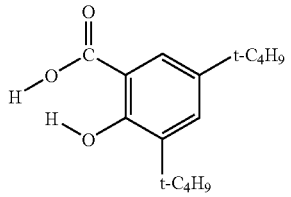

(II)

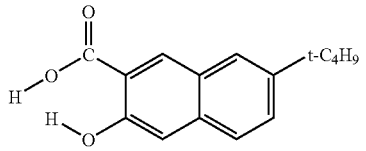

(III)

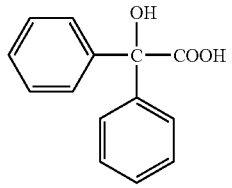

(IV)

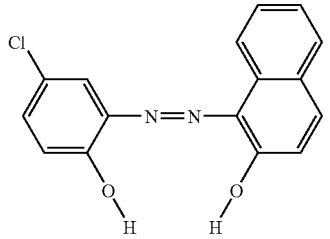

(V)

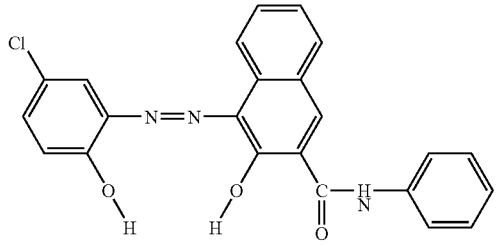

Shown below is a specific example of the metallic compound that uses the azo compound or the hydroxyl carboxylic acid illustrated previously.

(VI)

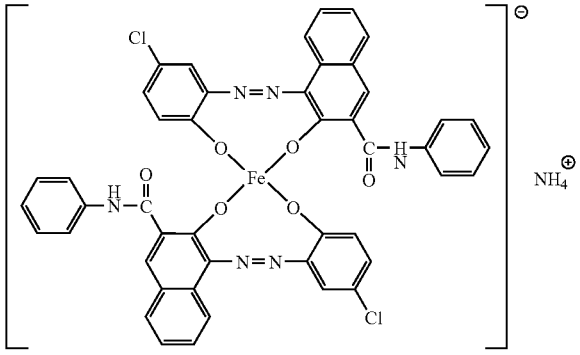

-continued (VII)

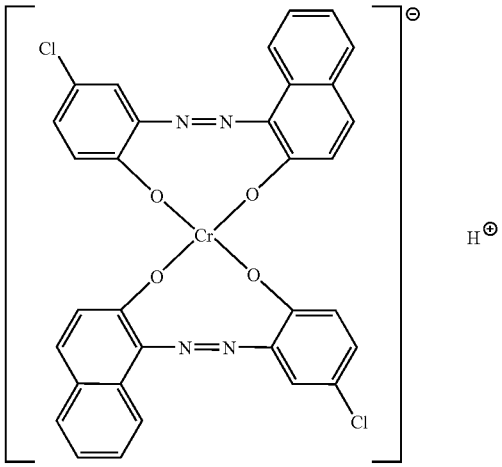

(VIII)

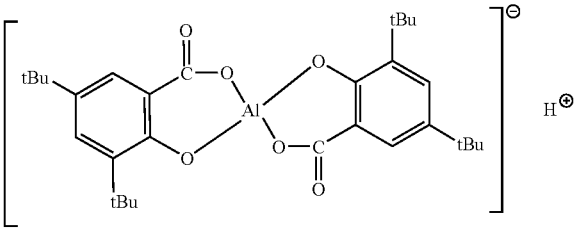

(IX)

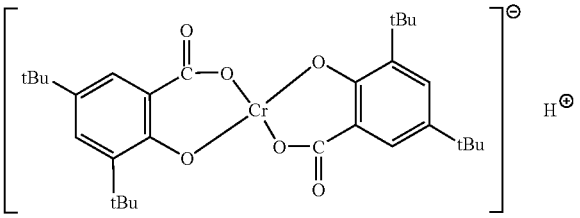

The toner of the present invention comprises wax. The wax to be used in the present invention preferably has a peak top temperature of the maximum heat absorption peak in the range of 70 to 120° C. (or more preferably 90 to 110° C.) in heat absorption peaks during a temperature rise measured by using a differential scanning calorimeter (DSC).

Examples of the wax used in the present invention include: aliphatic hydrocarbon waxes such as low molecular weight polyethylene, low molecular weight polypropylene, polyolefin copolymers, polyolefin wax, micro crystalline wax, paraffin wax, and Fischer-Tropsch wax; aliphatic hydrocarbon oxide waxes such as polyethylene oxide wax, or their block copolymers; vegetable waxes such as candelilla wax, carnauba wax, Japan wax, and jojoba wax; animal waxes such as bees wax, lanoline, and spermaceti; mineral waxes such as ozokerite, ceresin, and petrolatum; waxes having aliphatic ester as the main component such as montanoic acid ester wax and caster wax; and waxes such as deoxidized carnauba wax in which the aliphatic ester is partly or fully deoxidized.

Furthermore, the examples further include: a saturated normal chain fatty acid such as palmitic acid, stearic acid, montanoic acid, or a long-chain alkylcarboxylic acid having a longer-chain alkyl group; unsaturated fatty acids such as brassidic acid, eleostearic acid, and parinaric acid; a saturated alcohol such as stearyl alcohol, eicosyl alcohol, behenil alcohol, kaunabil alcohol, seryl alcohol, melissyl alcohol, or an alkyl alcohol having a longer chain alkyl group; a polyhydric alcohol such as sorbitol; aliphatic amides such as linoleic acid amide, oleic acid amide, and lauric acid amide; saturated aliphatic bisamides such as methylenebis stearic acid amide, ethylenebis capric acid amide, ethylenebis lauric acid amide, and hexamethylenebis stearic acid amide; unsaturated aliphatic amides such as ethylenebis oleic acid amide, hexamethylenebis oleic acid amide, N,N'-dioleyl adipic acidamide, and N,N'-dioleyl sebacic acidamide; aromatic bisamides such as m-xylenebis stearic acid amide, and N,N'-distearyl isophthalic acid amide; aliphatic metallic salts (generally known as metallic soap) such as calcium stearate, calcium laurate, zinc stearate, and magnesium stearate; wax prepared by grafting an aliphatic hydrocarbon wax using a vinyl monomer such as styrene, or acrylic acid; partially esterificated material of a fatty acid such as behenic acid monoglyceride and a polyhydric alcohol; and a methylester compound having a hydroxyl group obtained by adding hydrogen to the vegetable oil.

In addition, waxes that molecular weight distributions of the above-mentioned waxes are sharpened by using a pressing-sweating process, a solvent method, a recrystallization method, a vacuum distillation method, a supercritical gas extraction method, or a melt-crystallization method, and waxes that a low molecular weight solid fatty acid, a low molecular weight solid alcohol, a low molecular weight solid compound, and other impurities are removed from the above-mentioned waxes are preferable.

Of the waxes, preferred waxes to be used are those each having a solubility parameter (hereinafter referred to as SP value) of no more than 9 (preferably 7 to 9) and each having no polar group. The wax having the SP value of no more than 9 shows an extreme difference in polarity from the polyester resin, and the wax readily undergoes phase separation. When toner is melted by heat during fixation, the wax quickly percolates to the surface of the toner particle, and is therefore able to prevent an end offset phenomenon and to improve fixing property.

If the SP value is greater than 9, the difference between the wax polarity and resin polarity gets small. Phase separation of the wax becomes difficult. Therefore, the end offset phenomenon and fixing property may not be improved. High temperature offset may get bad. If the SP value is less than 7, the dispersion property of the wax tends to decline even if the isoelectric point of the magnetic material is controlled.

Examples of the preferable waxes include: polyolefine waxes such as low molecular weight polyethylene and low molecular weight polypropylene; paraffin wax; and Fischer-Tropsch wax. In particular, low molecular weight polyethylene wax and Fischer-Tropsch wax are preferred.

The solubility parameter (SP value) of wax is calculated using, for instance, Fedors' method (refer to Polymer Engineering & Science, 14 (2) 147 (1974)) which utilizes an additivity of an atomic group.

It is preferable to incorporate those waxes in an amount of 1 to 10 parts by mass for every 100 parts by mass of the binder resin. In particular, the wax is prepared in a reaction cisterna with a monomer during the polymerization of polyester resin. Alternatively, after the completion of the resin polymerization, the wax is added and stirred while the temperature is being applied to the reaction bucket prior to taking the resin out, and the wax is dispersed in the resin. Each of these processes is preferable in uniformly dispersing the wax within the binder resin.

In addition, the toner of the present invention preferably has a Carr's floodability index of greater than 80 and a Carr's fluidity index of greater than 60.

If toner has a good flowability, which indicates the floodability index of greater than 80, toner sticking or image whitening caused by an extreme force applied to a part of a stirrer member does not occur. For example, toner can be constantly stirred from a start of the cartridge usage until the toner is exhausted. Therefore, favorable developing performance is provided. Furthermore, even if the cartridge is stored under a high temperature and high humidity environment, the toner hardly agglomerates. Even such a storing, a favorable image is still output from the printer.

In addition, if the fluidity index is greater than 60, the amount of toner supply is constant throughout the prolonged usage under a high temperature and high humidity environment. It is possible to obtain a stable image characteristic where a decline in image density is controlled.

In addition, by making the floodability index and fluidity index greater than the values stated above, a flowability of the toner improves, and the toner may become stuck tight. As a result of this, thermal conductivity of the toners during fixation gets better, with the result that better fixing property is obtained.

Even if the floodability index is no more than 80, a high flowability is obtained. However, once the toner is stuck, the toner hardly returns to the normal flowing even though a force is applied. Even the stirrer member tries to convey the toner, the toner is not conveyed easily. As a result of this, inside the cartridge, for example, the toner is not conveyed to the sleeve. The toner is charged that the toner is set unevenly on the sleeve, therefore, toner charge also may get uneven to cause an uneven image.

Furthermore, if the floodability index is no more than 80 and the fluidity index is no more than 60, the toners are likely to agglomerate with one another, and become difficult to flow. For example, the toner cannot be conveyed smoothly from one container to the adjacent container inside the cartridge. Owing to this, the toner is not conveyed and causes image whitening. An appropriate amount of toner is not present on the sleeve. An amount of toner placed on the sleeve is reduced. As a result of these, a sleeve ghost may occur. Also, a toribo of the toner being held on the sleeve gets too high, and tends to cause fogging.

The floodability index and the fluidity index can be adjusted by sufficiently adjusting the types and the amount of external additives such as a flowability improving agent. Existence situations of various external additives change by checking an external additive formulation of the toner. Therefore, the powder characteristic of the toner also changes, and eventually the floodability index can be changed.

The flowability improving agent can increase the flowability by being externally added to the toner particle. The increase is observed by comparing flowability before and after adding the agent. Normally, the flowability improving agent has the same polarity charge as that of the toner.

Examples of such a flowability improving agent include: fluororesin powder such as vinylidene fluoride fine powder, and polytetrafluoroethylene fine powder; fine powder silica obtained a process of silica, such as dry process production silica and wet process production silica, titanium oxide fine powder, and alumina fine powder, which are surface-processed by a silane compound, titanium coupling agent, or silicone oil; oxides such as zinc oxide and tin oxide; double oxides such as strontium titanate, barium titanate, calcium titanate, strontium zirconate, and calcium zirconate; and carbonate compounds such as calcium carbonate and magnesium carbonate.

The preferred flowability improving agent is a fine powder material produced by vapor phase oxidation of the silicon halogen compound so-called dry process silica or fumed silica. For example, the thermal decomposition oxidation reaction of the silicon tetrachloride gas in the oxyhydrogen flame is used. The basic reaction formula is as below.

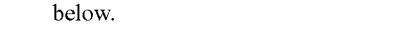

$$SiCl_4+2H_2+O_2 \rightarrow SiO_2+4HCl$$

It is possible to obtain complex fine powder of silica and other metal oxide compounds based on this manufacturing process by using silicon halogen compound together with other metallic halogen compound such as aluminum chloride or titanium chloride. The above-mentioned silica contains them as well. A particle size of the powder is preferably in the range of 0.001 to 2 μm as an averaged primary powder particle diameter. Especially, the particle size of the fine powder silica in the range of 0.002 to 0.2 μm is more preferred.

Examples of the commercially available fine powder silica which is made by the vapor phase oxidation of the silicon halogen compound include: AEROSIL (Nippon Aerosil Ltd.) 130, 200, 300, 380, TT600, MOX 170, MOX80, and COK84; Ca-O-SiL (CABOT Co. Ltd.) M-5, MS-7, MS-75, HS-5, and EH-5; WackerHDKN20 (WACKER-CHEMIEGMBH Ltd.) V15, N20E, T30, and T40; D-CFineSilica (Dow Corning Co. Ltd.); and Fransol (Fransil Ltd.). These are preferably used in the present invention.

A preferred flowability improving agent used in the present invention is processed fine powder silica hydrophobicizing the fine powder silica formed by the vapor phase oxidation of the silicon halogen compound. Regarding to the processed fine powder silica, it is preferable to process the fine powder silica such that a hydrophobicity measured using a methanol titration test is in the range of 30 to 80.

The hydrophobicity is imparted by chemically treating with an organic silicon compound that reacts with or physically absorbs to the fine powder silica. The preferred method is processing the fine powder silica produced by the vapor phase oxidation of the silicon halogen compound with the organic silicon compound.

Examples of the above mentioned organic silicon compound include hexamethyldisilazane, trimethylsilane, trimethylchlorosilane, trimethylethoxysilane, dimethyldichlorosilane, methyltrichlorosilane, allyldimethylchlorosilane,-allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and a silane coupling agent such as dimethylpolysiloxane having 2-12 siloxane units per one molecule, and containing a hydroxyl group each bonded with Si within a unit located in a terminal. Further, silicone oils such as dimethyl silicone oil, alkyl modified silicone oil, α-methyl styrene modified silicone oil, chlorophenyl silicone oil, and fluorine modified silicone oil can be given. These are used solely or used in combination of two or more kinds. In addition, the silicone varnish can be used as the processing agent. For example, KR-251 and KP-112 manufactured by Shinetsu Silicone Ltd., can be used.

Furthermore, the fine powder silica is preferably processed by a combination of the silane coupling agent with one of the silicone oil or the silicone varnish. The fine powder silica is preferably processed by processing with one of the silicone oil or the silicone varnish after processing with the silane coupling agent. The particularly preferable method is by processing with dimethyl silicone oil after processing with hexamethyldisilazane.

The flowability improving agent preferably have a specific surface area, which is measured using BET method by nitrogen adsorption, of 30 $m^2/g$ or more, or more preferably 50 $m^2/g$ or more, or still more preferably in the range of 70 to 150 $m^2/g$ for a good result. For every 100 parts by mass of toner particles, the desirable amount of flowability improving agents to be used is 0.01 to 8 parts by mass, preferably 0.1 to 4 parts by mass, and more preferably 0.5 to 3 parts by mass.

Specific examples of compositions for attaining the floodability index and the fluidity index described above include: a composition that uses the hydrophobic fine powder silica (same polarity as that of the toner) as the flowability improving agent and uses a fine particle agglomerate charging in the same polarity as that of the toner; a composition that further adds a fine resin particle charging in a polarity opposite to that of the toner as a third external additive; and a composition that further adds a metal oxide as a fourth external additive.

The fine particle aggregate used in the present invention is composed of fine particles, and silicone oil or silicone varnish. The fine particle comprises much silicone oil or silicone varnish. The amount of silicone oil or silicone varnish is 20 to 90% by mass of the total amount of the fine particle aggregate.

The fine particles are composed of one or both of an inorganic compound fine particle and an organic compound fine particle. Examples of the organic compound include resin particle aliphatic compounds such as styrene resin, acrylic resin, silicone resin, silicone rubber, polyester resin, urethane resin, polyamide resin, polyethylene resin, and fluororesin.

In addition, the examples of the inorganic compound include: oxides such as $SiO_2$, $GeO_2$, $TiO_2$, $SnO_2$, $Al_2O_3$, $B_2O_3$, $P_2O_5$, and $As_2O_3$; and metal oxide salts such as silicates, borates, phosphates, germanates, borosilicates, aluminosilicates, aluminoborates, aluminoborosilicates, tungstates, molybdates, and tellurates; and their complex compounds; silicon carbide; silicon nitride; and amorphous carbon. Those compounds are individually used or may be used in combination of two or more kinds. The inorganic compound fine particles manufactured by using the dry process and the wet process are usable as the inorganic compound.

For silicone oil and silicone varnish contained in the fine aggregates, general materials such as those described above can be used.

As described above, the fine particle aggregate contains relatively a large amount of materials having excellent releasing property such as silicone oil and silicone varnish by an amount of 20 to 90% by mass. This improves the releasing property of the toner and a surface of the electrostatic latent image bearing member.

When the amount of silicone oil or silicone varnish is less than 20% by mass, the environmental safety is liable to lack. On the other hand, if the amount exceeds 90% by mass, the silicone oil or silicone varnish is hardly held in the fine particle such that excessive silicone oil or silicone varnish agglomerates the toner particles, which tends to cause image deterioration. The amount of silicone oil or silicone varnish in the fine particle aggregate is preferably 27 to 85% by mass, more preferably 40 to 80% by mass.

Of the silicone oil and the silicone varnish, the silicone oil is preferred over the silicone varnish because the silicone oil is easily applied to the surface of the electrostatic latent image bearing member. Also, the silicone oil preferably contains no alkoxyl group in terms of prevention of voids.

In addition, the silicone oil or the silicone varnish is held stably as particles formed into grains together with the fine particles. Owing to the silicone oil or the silicone varnish, the toner does not agglomerate while the toner is being stored. This greatly contributes to obtaining a good quality image without roughness, scattering, or the like.

In addition, the fine particle aggregate contains a large amount of compounds similar to the hydrophobicizing agent used in the hydrophobic silica, therefore, its charging property is of the same polarity of the hydrophobic silica. As described previously, the fine particle aggregate electrically repels from the hydrophobic silica. This contributes to uniformly dispersing the hydrophobic silica at the surface of the toner particle.

The BET specific surface area of the fine particle aggregate is preferably 0.01 to 50 $m^2/g$ (or more preferably 0.05 to 30 $m^2/g$) Image quality tends to deteriorate if the BET specific surface area of the fine particle aggregate is less than 0.01 $m^2/g$. Silicone oil or silicone varnish is hardly held as particles if the BET specific surface area is greater than 50 $m^2/g$. Thus, toner agglomeration is caused, and image is likely to deteriorate.

An amount of the fine particle aggregates to be added is preferably 0.01 to 3.0 parts by mass for every 100 parts by mass of toner particles. Dispersion of the hydrophobic fine powder silica becomes worse if the amount of the fine particle aggregate to be added is less than 0.01 parts by mass. The charge-rise phenomenon is likely to occur if the amount to be added is more than 3.0 parts by mass.

The resin fine particle used in the present invention is a fine particle composed of a resin having a polarity that is opposite from the toner. The resin fine particle is not particularly limited, as long as the resin fine particle is a resin having a polarity that is opposite from the toner. However, as the polyester resin is being used as the binder resin in the toner of the present invention, the polarity of the toner is negative charge normally. Because of this charge property, the melamine resin is commonly used as the resin of the resin fine particle.

Examples of such melamine resin include one formed by condensation of melamine and formaldehyde, which is made into ether by treating with aliphatic alcohol, and one prepared by denaturing this melamine resin using p-toluen sulfonic amide. Of course, the melamine resin is not restricted to those.

The BET specific surface area of the resin fine particle is preferably 5.0 to 70 $m^2/g$ (more preferably 10 to 40 $m^2/g$). If the BET specific surface area of the resin fine particle is smaller than 5.0 $m^2/g$, an absorbing amount of free fine particle aggregates is decreased, which is not preferred at all. If the BET specific surface area of the resin fine particle is greater 70 $m^2/g$, scraping of the electrostatic latent image bearing member by the metal oxide cannot sufficiently be eased.

An amount of the resin fine particle to be added is preferably 0.005 to 0.5 parts by mass for every 100 parts by mass of toner particles. Polishing power of the metal oxide cannot be eased with a good balance if the amount of the resin fine particle is less than 0.005 parts by mass. The charging roller may get dirty clearly owing to cleaning failure if the amount is more than 0.5 parts by mass.

Various metal oxides can be used as the metal oxide used in the present invention. The preferred metal oxides are those that charge in opposite polarity from the toner. Examples of the metal oxide include: oxides of magnesium, zinc, cobalt, zirconium, manganese, cerium, and strontium; and complex metal oxides such as calcium titanate, magnesium titanate, strontium titanate, and barium titanate. Of those mentioned above, strontium titanate and cerium oxide are the most desirable from the notions of polishing property of the electrostatic latent image bearing member and a charging property of the toner.

The BET specific surface area of the metal oxide is preferably 0.5 to 10.0 $m^2/g$ (or more preferably 1 to 10 $m^2/g$). Scraping of the surface of the electrostatic latent image bearing member or the developer bearing member (sleeve) becomes prominent if the BET specific surface area of the metal oxide is less than 0.5 $m^2/g$. A substance attached to the surface of the electrostatic latent image bearing member may not be removed or may lead to image imperfection going through the cleaning member if the BET specific surface area of metal oxide is more than 10.0 $m^2/g$.

An amount of the metal oxide to be added is preferably 0.05 to 5.0 parts by mass (more preferably 0.05 to 2.0 parts by mass) for every 100 parts by mass of toner particles. The polishing power with respect to the electrostatic latent image tends to get insufficient if the amount of the metal oxide to be added is less than 0.05 parts by mass. The electrostatic latent image bearing member may be unevenly and more than necessary scraped if the amount of the metal oxide to be added is more than 5.0 parts by mass, and also the toner fluidity may be reduced.

Also, in the present invention, when the previously described four external additives are all added, these exist uniformly on the individual toner particle surface owing to an electrical balance of the four types of external additives. The charging amount is stabilized for a prolong period of time, and it is preferable in preventing occurrence of problems such as tailing even in a high speed developing system.

Effects retrieved from kinds of external additives of the present invention and their combinations are described hereinbelow.

Hydrophobic silica improves the flowability, and presents stable developing performance without absorbing moistness under a humid environment. Moreover, the silica scratches impurities attached to a drum off the drum, and the silica prevents re-attachment of the impurities to the drum again.

By adding, to the hydrophobic silica, a fine particle aggregate having the same polarity as that of the hydrophobic silica, an electrical repellant force arises among the external additives. This is effective in suppressing an agglomeration of the hydrophobic silica. This is also effective in dispersing the hydrophobic silica uniformly to the surface of the toner. Furthermore, this is also effective in scratching fine impurities on the drum off.

By adding a positively-charged metal oxide to the negatively-charged particle, the charge property of the toner is stabilized. Impurities strongly attached on the drum are scratched off. A stable image is provided, which is free of image deletion or fusing to the drum even if under a high temperature and high humidity environment.

In addition, the charge stability improves even more by adding positively-charged resin fine particles to the mixture.

A high quality image may be provided without trailing in the high-speed developing system.

Regarding to measurement of the Carr's fluidity index and the Carr's floodability index described in the present specification, refer to JP 51-14278B for details. A method for the measurement is not particularly restricted, however, the following measurement method is used in the present invention.

That is, parameters, that is, an angle of repose, an angle of fall, an angle of difference, a compressibility, a cohesiveness, an angle of spatula, and a dispersibility are measured by using Powder Tester P-100 (manufactured by Hosokawa Micron Co., Ltd.). Referring to Carr's floodability index table and fluidity index table (refer to Chemical Engineering, Jan., 18, 1965), match the measured values to these tables and convert the results to the respective indexes, and get the sum of indexes determined from the parameters as the floodability index and the fluidity index.

An example of the measurement method of each parameter is described hereinbelow.

(1) Angle of Repose 150 g of toner is sieved through a 710 μm mesh. The sieved toner is collected on a round table having a diameter of 8 cm, which is collected to an extent that the toner overflows from an edge of the round table. An angle between a ridgeline of the collected toner on the table and a surface of the round table is measured by using a laser beam. This angle is the angle of repose.

(2) Compressibility

The compressibility is expressed by the equation shown below, which is worked out from a sparse filling bulk density (the loose apparent specific gravity, denoted by 'A') and the tapping bulk density (a solid apparent specific gravity, denoted by 'B').

$$\text{Compressibility } (\%)=100(P-A)/P$$

The loose apparent specific gravity is determined as follows. 150 g of toner is carefully poured into a cup having a diameter of 5 cm, a height of 5.2 cm, and a capacity of 100 ml, pouring the toner is stopped just before overflowing from the cup, and then a cup top is flattened. The loose apparent specific gravity determined by calculating a specific gravity of the toner being filled inside the cup based on an amount of the toner being filled inside the cup and the capacity of the cup.

The solid apparent specific gravity is determined as follows. Extend an appended cap to the cup used in measuring the loose apparent specific gravity, fill the cup with toner, tap the cup 180 times, remove the cap after tapping, and flatten the cup top to remove extra toner. The solid apparent specific gravity is determined by calculating a specific gravity of the toner being filled inside the cup based on an amount of the toner being filled inside the cup and the capacity of the cup. Compressibility is determined by substituting both the apparent specific gravity values into the above expression.

(3) Angle of Spatula

A spatula of 3 cm×8 cm in size is placed to be in contact with a bottom of a bat having a size of 10 cm×15 cm. Toner is collected on the spatula. Note that the toner is collected on the spatula in a chunk. Then, just the bat is carefully put down. An angle of inclination that is an angle of lateral plane of the remaining toner on the spatula is measured using a laser beam. A shocker equipped on the spatula is used to give a shock once. The angle of lateral plane of the remaining toner on the spatula is measured again. An average value of the measured angles and the measured angle before giving the shock is the angle of spatula.

(4) Cohesiveness

Vertically set sieves having sizes of 250 μm, 150 μm, and 75 μm, in this order, on a shaker table. Carefully place 5 g of toner on the upper sieve, and shake for 20 seconds at a shaking width of 1 mm. After shaking is stopped, a weight of the toner remaining on each sieve is measured. The weight of remaining toner on each sieve is used to work out parameters a, b, and c based on the equations shown below. A total sum of a, b, and c gives the cohesiveness (%).

$$a=(\text{remaining toner weight on the upper sieve})\div 5\ (g)\times 100$$

$$b=(\text{remaining toner weight on the middle sieve})\div 5\ (g)\times 100\times 0.6$$

$$c=(\text{remaining toner weight on the lower sieve})\div 5(g)\times 100\times 0.2$$

(5) Angle of Fall

After measuring the angle of repose, give three shocks to the bat on which the round table for measurement is placed by using the shocker. After that, measure the angle of the toner left on the table using a laser beam. This is the angle of fall.

(6) Angle of Difference

A difference between the angle of repose and the angle of fall is calculated. This is the angle of difference.

(7) Dispersibility

Drop a lump of 10 g toner onto a 10 cm diameter watch glass from a height of approximately 60 cm. Then, measure the toner left on the watch glass. The dispersibility is determined based on the equation shown below.

$$\text{Dispersibility}(\%)=[10-(\text{amount of toner left on the watch glass})]\times 10$$

A total sum of indexes obtained the parameters (1), (2), (3) and (4) ((1)+(2)+(3)+(4)) is the Carr's fluidity index. A total sum of the Carr's fluidity index and indexes obtained the parameters (5), (6), and (7) is the Carr's floodability index.

TABLE 1

| Angle of repose | | Compressibility | | Angle of spatula | | Cohesiveness | |
|---|---|---|---|---|---|---|---|
| Degree | Index | % | Index | Degree | Index | % | Index |
| <25 | 25 | <5 | 25 | <25 | 25 | | |
| 26-29 | 24 | 6-9 | 23 | 26-30 | 24 | | |
| 30 | 22.5 | 10 | 22.5 | 31 | 22.5 | | |
| 31 | 22 | 11 | 22 | 32 | 22 | | |
| 32-34 | 21 | 12-14 | 21 | 33-37 | 21 | | |
| 35 | 20 | 15 | 20 | 38 | 20 | | |
| 36 | 19.5 | 16 | 19.5 | 39 | 19.5 | | |
| 37-39 | 18 | 17-19 | 18 | 40-44 | 18 | | |
| 40 | 17.5 | 20 | 17.5 | 45 | 17.5 | | |
| 41 | 17 | 21 | 17 | 46 | 17 | | |
| 42-44 | 16 | 22-24 | 16 | 47-59 | 16 | | |
| 45 | 15 | 25 | 15 | 60 | 15 | <6 | 15 |
| 46 | 14.5 | 26 | 14.5 | 61 | 14.5 | 6-9 | 14.5 |
| 47-54 | 12 | 27-30 | 12 | 62-74 | 12 | 10-29 | 12 |
| 55 | 10 | 31 | 10 | 75 | 10 | 30 | 10 |
| 56 | 9.5 | 32 | 9.5 | 76 | 9.5 | 31 | 9.5 |
| 57-64 | 7 | 33-36 | 7 | 77-89 | 7 | 32-54 | 7 |
| 65 | 5 | 37 | 5 | 90 | 5 | 55 | 5 |
| 66 | 4.5 | 38 | 4.5 | 91 | 4.5 | 56 | 4.5 |
| 67-89 | 2 | 39-45 | 2 | 92-99 | 2 | 57-79 | 2 |
| 90 | 0 | >45 | 0 | >99 | 0 | >79 | 0 |

TABLE 2

| Fluidity Index from Table 1 | Index | Angle of fall Degree | Index | Angle of difference Degree | Index | Dispersibility % | Index |
|---|---|---|---|---|---|---|---|
| >60 | 25 | 10 | 25 | >30 | 25 | >50 | 25 |
| 59-56 | 24 | 11-19 | 24 | 29-28 | 24 | 49-44 | 24 |
| 55 | 22.5 | 20 | 22.5 | 27 | 22.5 | 43 | 22.5 |
| 54 | 22 | 21 | 22 | 26 | 22 | 42 | 22 |
| 53-50 | 21 | 22-24 | 21 | 25 | 21 | 41-36 | 21 |
| 49 | 20 | 25 | 20 | 24 | 20 | 35 | 20 |
| 48 | 19.5 | 26 | 19.5 | 23 | 19.5 | 34 | 19.5 |
| 47-45 | 18 | 27-29 | 18 | 22-20 | 18 | 33-29 | 18 |
| 44 | 17.5 | 30 | 17.5 | 19 | 17.5 | 28 | 17.5 |
| 43 | 17 | 31 | 17 | 18 | 17 | 27 | 17 |
| 42-40 | 16 | 32-39 | 16 | 17-16 | 16 | 26-21 | 16 |
| 39 | 15 | 40 | 15 | 15 | 15 | 20 | 15 |
| 38 | 14.5 | 41 | 14.5 | 14 | 14.5 | 19 | 14.5 |
| 37-34 | 12 | 42-49 | 12 | 13-11 | 12 | 18-11 | 12 |
| 33 | 10 | 50 | 10 | 10 | 10 | 10 | 10 |
| 32 | 9.5 | 51 | 9.5 | 9 | 9.5 | 9 | 9.5 |
| 31-29 | 8 | 52-56 | 8 | 8 | 8 | 8 | 8 |
| 28 | 6.25 | 57 | 6.25 | 7 | 6.25 | 7 | 6.25 |
| 27 | 6 | 58 | 6 | 6 | 6 | 6 | 6 |
| 26-23 | 3 | 59-64 | 3 | 5-1 | 3 | 5-1 | 3 |
| <23 | 0 | >64 | 0 | 0 | 0 | 0 | 0 |

The toner of the present invention is usable as a one component developer, and is also usable as a two component developer by mixing with a carrier. As the carrier to be used in the two component developer, every carrier that is conventionally known is usable. In more specific terms, metals such as surface oxidized or unoxidized iron, nickel, cobalt, manganese, chromium, and rare-earth elements, and their alloys or oxides, each having a volume average particle diameter of 20 to 500 μm are preferred.

In addition, carrier particles surfaces of which are attached by or coated with substances such as styrene resin, acrylic resin, silicone resin, fluororesin, and polyester resin are preferably used.

The method for manufacturing the toner of the present invention is not particularly limited, as long as the toner is provided with the previously described physical properties. One example of the method for manufacturing the toner of the present invention is described hereinbelow.

As the method for manufacturing the toner of the present invention, a mixture comprising at least a binder resin having a polyester resin as the main component, a wax and a colorant is used as the material. Magnetic materials, charge control agents, and other additives may also be used as required. These materials are mixed together using a mixer such as Henschell Mixer or a ball mill sufficiently. Then, the mixed materials are melted and kneaded in a thermal kneader such as a roll, a kneader, or a extruder. The wax and magnetic material are dispersed in a liquid phase containing resins. After cooling and consolidation, the consolidated phase is pulverized and classified. The toner is obtained accordingly. According to the method for manufacturing the toner of the present invention, the following manufacturing machines may be used depending on circumstances.

Examples of the toner manufacturing device include: as the mixer, Henschel mixer (manufactured by Mitsui Mining Co., Ltd.); Super mixer (manufactured by Kawata Mfg. Co., Ltd.); Riboconne (manufactured by Okawara MFG. Co., Ltd.); Nauta mixer, Turbulizer and Cycromix (manufactured by Hosokawa Micron Co., Ltd.); Spiral pin mixer (manufactured by Pacific Machinery & Engineering Co., Ltd.); and Redige mixer (manufactured Matsubo Co., Ltd.).

Examples of the kneader include: KRC kneader (manufactured by Kurimoto Ironworks Co., Ltd.); Buss-Co-Kneader (manufactured by BUSS Co., Ltd); TEM extruder (manufactured by Toshiba Co., Ltd); TEX biaxial kneader (manufactured by Japan Steel Works Co., Ltd.); PCM kneader (manufactured by Ikegai Steelworks Co., Ltd); Three roll mill, Mixing roll mill, Kneader (manufactured by Inoue Manufacturing Co., Ltd.); Kneadex (manufactured by Mitsui Mining Co., Ltd.); MS type pressurizing kneader, and Kneadaruder (manufactured by Moriyama Manufacturing Co., Ltd.); and Banbury mixer (manufactured by Kobe Steel Co., Ltd.).

Examples of the pulverizer include: Counter jet mill, Micron jet, and Inomizer (manufactured by Hosokawa Micron Co., Ltd.); IDS type mill, and PJM jet pulverizer (manufactured by Japan Pneumatic Co., Ltd.); Crossjet Mill (manufactured by Kurimoto Ironworks Co., Ltd.); Urumax (manufactured by Nisso Engineering Co., Ltd.); SK Jet-O-Mill (manufactured by Seisin Enterprise Co., Ltd.); Cliptron (manufactured by Kawasaki Heavy Industries); Turbo Mill (manufactured by Turbo Kogyou Co., Ltd.); and Super Rotor (manufactured by Nisshin Engineering Co., Ltd.).

Examples of the classifier include: Classiel, Micron Classifier, and Spedic Classifier (manufactured by Seisin Enterprises Co., Ltd.); Turbo Classifier (manufactured by Nisshin Engineering Co., Ltd.); Micron separator, Turboplex (ATP), and TSP Separator (manufactured by Hosokawa Micron Co., Ltd.); Elbow-Jet (manufactured by Nittetsu Mining Co., Ltd.); Dispersion Separator (manufactured by Japan Pneumatic Co., Ltd.); and YM Microcut (manufactured by Yasukawa Trading Co., Ltd).

Examples of the sieving device for sifting powder etc., include: Ultra Sonic (manufactured by Koei Manufacturing Co., Ltd.); Resona Sieve, and Gyro Sifter (manufactured by Tokujyu Kousakusho Co., Ltd); Vibrasonic System (manufactured by Dalton Co., Ltd.); Soniclean (manufactured by Sintokogio Co., Ltd.); Turbo Screener (manufactured by Turbo Kogyo Co., Ltd.); Micro Sifter (manufactured by Makino Manufacturing Co., Ltd.); and Circular Oscillation Screens, etc.

The toner of the present invention, responding to its types, can be used in image formation by means of the well-known image forming devices having appropriate structures. In addition, when utilizing the toner of the present invention in image formation, one of the preferred embodiments of the present invention is to construct a process cartridge including structural elements such as a developing device having the toner as described above, an image bearing member (such as a photosensitive drum), a charging member, and a cleaning member, two or more of which are assembled to be one device unit. This process cartridge is detachably attached to a main body of the image forming device.

For example, the process cartridge is formed as a single detachable unit by supporting the charging member, the developing device, and the photosensitive drum as one. The process cartridge is designed to be detachably attached to the main body of the image forming device using guidance means such as a rail built in the main body of the image forming device.

Methods of measuring various physical properties related to the toner of the present invention will be described hereinbelow. In the present invention, the following physical properties can be measured using the methods described below. The melt index (MI) of the toner and the cross-linked polyester component, the molecular weight distribution of the THF soluble component of the toner and the binder resin, the content of the THF insoluble component, the Tg (glass transition temperature), the acid value of the binder resin, and the hydroxyl value can be measured.

(1) Method of Measuring MI for Toner and Cross-linked Polyester Component

The melt index (MI) is measured by using a machine (the melt indexer load moving device of Takara Industry Ltd.,), which is mentioned in JISK7210. The measurement is carried out by a manual cutting method under the measurement conditions shown below. At this time, the measured values are converted every 10 minutes.

Measurement temperature: 125° C. (toner), 190° C. (cross-linked polyester component)

Load: 5 kg (toner), 10 kg (cross-linked polyester component)

Loading weight of sample: 5 to 10 g (2) Measurement of Molecular Weight of THF Soluble Component of Toner A molecular weight of a chromatogram based on the gel permeation chromatography (GPC) is measured under the following conditions.

A column is stabilized in a heat chamber at 40° C. Tetrahydrofuran (THF) is poured into the column at this temperature at a flow rate of 1 ml/min as a solvent. In order to accurately measure a molecular weight region of $10^3$ to $2\times10^6$, a plurality of commercially available polystyrene gel columns sold are appropriately combined to be used as the column. Examples of the preferred combinations include: combinations of shodex GPCKF-801, 802, 803, 804, 805, 806, 807, and 800P of Showa Denko Ltd.,; and combinations of TSK gel G 1000 H ($H_{XL}$), G 2000 H ($H_{XL}$), G 3000 H ($H_{XL}$), G4000 H ($H_{XL}$), G 5000 H ($H_{XL}$), G 6000 H ($H_{XL}$), G 7000 H ($H_{XL}$), and TSKgurd column of Tosoh Ltd.,. Especially, combinations of 7 series of columns of shodex KF-801, 802, 803, 804, 805, 806, and 807 of Showa Denko Ltd., are preferred.

In the meantime, the toner is dispersed and dissolved into THF, the solution was then left standing for one night, the solution is filtered using a sample processing filter (having a pore size of 0.2 to 0.5 μm, for example, Maishoridisuku H-25-2 (Tosoh Ltd.,) maybe used), and the filtrate is used as the sample. The molecular weight is measured by injecting 50 to 200 μl of a solution of toner in THF prepared so that, as for the sample concentration, the resin component is in the range of 0.5 to 5 mg/ml. Note that an RI (refractive index) detector is used as the detector.

Regarding to the measurement of the molecular weight of the sample, the sample molecular weight distribution is calculated from a relation of logarithm of calibration curves drawn by several types of dispersed polystyrene standard samples and the count numbers. Examples of the standard polystyrene samples for use in drawing the calibration curve include, those that have molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^5$ manufactured by Pressure Chemicals Co. Ltd., or Toyo Soda Industrial Ltd.,. It is preferable to use at least 10 standard polystyrene samples.

(3) Amount of THF Insoluble Component

The polyester resin or the toner is weighed, and the weighed sample is placed in a cylindrical filter (for example, No. 86 R sized 28×10 mm of Toyo Roshi Ltd.), and the whole is applied to Soxhlet extractor. 200 ml of THF is used as a solvent. The sample is extracted for 16 hours. At this time, the extraction is carried out at a reflux rate such that a THF extracting cycle is once per about 4 to 5 minutes. After the completion of the extraction, the cylindrical filter is removed and weighed to obtain a THF insoluble component of the polyester resin or the toner.

If the toner comprises a THF insoluble component other than the resin component such as a magnetic material or pigment, then the amount of the THF insoluble component of the resin component in the toner is determined from the equation below. $W_1$ g denotes amass of the toner thrown into the cylindrical filter. $W_2$ g denotes a mass of the extracted THF soluble resin component. $W_3$ g denotes a mass of the THF insoluble component of the resin component comprised in the toner.

$$\text{Weight of THF insoluble component (\% by mass)} = [W_1-(W_3+W_2)]/(W_1-W_3)\times100$$

(4) Measurement of Glass Transition Temperature (Tg)

The glass transition temperatures (Tg) of the toner and the binder resin are measured by using a differential scanning calorimeter (DSC measurement equipment), DSC-7 (manufactured by Perkinelmer Ltd.,), DSC2920 (manufactured by TA Instruments Japan Ltd.,) or other equipment, according to ASTM D3418-82.

5 to 20 mg, or preferably to 10 mg of the measurement sample is exactly weighed. The weighed sample is placed on an aluminum pan. As a reference, an empty aluminum pan is also used to carry out the measurement under a normal temperature normal humidity environment, at ascending temperature rate of 10° C./minute, and in a measurement temperature range of 30° C. to 200° C.

In this ascending temperature process, a change in specific heat is observed within the temperature range of 40° C. to 100° C. At this time, there is an intersection point of a middle line and a differential thermal curve, the middle line is between base lines before and after the specific heat change. This intersection point is defined as the glass transition temperature of the toner or the binder resin of the present invention.

(5) Measurement of Acid Value

The acid value is obtained by the operations 1)-5) described below. The basic operations are categorized to JIS K 0070.

1) Additives other than the binder resin (polymer component) are removed from the sample beforehand. Alternatively, the acid value of components of the sample other than the binder resin is worked out beforehand. 0.5 to 2.0 g of a pulverized product of the toner or the binder resin is weighed. W g denotes a mass of a binder resin component at the time.
2) The sample is placed into a 300 ml beaker, and 150 ml of a toluene/ethanol (4/1) mixture is added to dissolve the sample.
3) The sample is subjected to measurement by using a potentiometric titrator, using a 0.1 mol/l ethanol solution of KOH. For example, automated titration utilizing a potentiometric titrator equipment AT-400 (winworkstation) and an automatic burette ABP-410 of Kyoto Denshi Ltd., may be used in this titration.
4) S denotes an amount of the KOH solution used (in ml) at the time. B denotes an amount of the KOH solution used in measuring the blank (in ml).
5) The acid value is calculated by using the equation below. f in the equation represents a factor of the KOH solution.

$$\text{Acid value (mgKOH/g)} = \{(S-B)\times f\times5.61\}/W$$

(6) Measurement of Hydroxyl Value

The hydroxyl value is determined from the operations 1)-8) described below. The basic operation is categorized to JIS K 0070.

1) All additives other than the binder resin (polymer component) are removed from the sample beforehand. Alternatively, a content of the components in the sample other than the binder resin is worked out beforehand. 0.5 to 2.0 g of a pulverized product of the toner or the binder resin is weighed in a 200 ml flat-bottom flask.
2) 5 ml of an acetylating reagent (prepared by charging 25 mg of acetic anhydride into a 100 ml volumetric flask, adding pyridine to make a total amount of 100 ml, and stirring well) is added to the flat-bottom flask. If the sample does not dissolve well, then a small amount of pyridine is added, or xylene or toluene is added.
3) A small funnel is placed on a flask top, and the flask is heated in a glycerin bath at a temperature of 95° C. to 100° C. so that a lower part of the flask is immersed in the bath about 1 cm deep. A flask's lower neck is covered with a disc-shaped thick paper having a circular hole at its center to prevent a rise in the temperature at the flask's neck owing to heat from the glycerin bath.
4) The flask is taken out of the glycerin bath an hour later, the flask is cooled by leaving the flask still, 1 ml of water is added through the funnel, and the flask is shaken well to decompose the acetic anhydride.
5) The flask is warmed in the glycerin bath for 10 minutes again for completely decomposing acetic anhydride, the flask is cooled by leaving the flask still, and the funnel and the flask wall are washed with 5 ml of ethanol.
6) Several drops of phenolphthalein solution are added to the flask as an indicator, titration is performed with a 0.5 kmol/m$^3$ potassium hydroxide ethanol solution until pale red color of the indicator continues for about 30 seconds. This is an endpoint.
7) 2)-6) are preformed without the resin as a control test.
8) The hydroxyl value is calculated by using the equation below.

$$A=[\{(B-C)\times 28.05\times f\}/S]+D$$

(Note that A denotes a hydroxyl value (mgKOH/g), B denotes an amount of the 0.5 kmol/m$^3$ potassium hydroxide ethanol solution (in ml) used in the control test, C denotes an amount of the 0.5 kmol/m$^3$ potassium hydroxide ethanol solution (in ml) used in the titration, f denotes a factor of the 0.5 kmol/m$^3$ potassium hydroxide ethanol solution, S denotes an amount of the binder resin (in g) contained in the sample, D denotes an acid value of the sample, and the value "28.05" in the equation above is a formula weight of potassium hydroxide (56.11×1/2).)

EXAMPLE

Hereinbelow, the example of the present invention will be described in more detail. However, note that this explanation does not restrict any aspect of the present invention.

Binder Resin Manufacturing Examples

Polyester Resin Manufacturing Example 1

| | |
|---|---|
| Terephthalic acid | 25 parts by mass |
| Trimellitic anhydride | 3 parts by mass |
| Bisphenol derivative represented by the formula (A) (wherein R: propylene group, average of x + y = 2.2) | 72 parts by mass |

0.5 parts by mass of dibutyltin oxide was added as a catalyst to the mixture above. A condensation polymerization reaction took place in the mixture at 220° C. Then low molecular weight polyester resin L-1 comprising no THF insoluble component (Tg: 56° C., THF insoluble component: 0% bymass, Mn: 4000, Mw: 7600, peak molecular weight: 9100, acid value: 11 mgKOH/g, hydroxyl value: 34 mgKOH/g) was obtained.

Polyester Resin Manufacturing Example 2

| | |
|---|---|
| Terephthalic acid | 18 parts by mass |
| Isophthalic acid | 3 parts by mass |
| Trimellitic anhydride | 7 parts by mass |
| Bisphenol derivative represented by the formula (A) (wherein R: propylene group, average of x + y = 2.2) | 70 parts by mass |
| Oxyalkylene ether of novolak type phenolic resin represented by the formula (C) (wherein R = ethylene group, average of x = 2.6, average of each of y1, y2, and y3 = 1.0) | 2 parts by mass |

0.5 parts by mass of dibutyltin oxide was added as a catalyst to the mixture above. A condensation polymerization reaction took place in the mixture at 240° C. Then cross-linked polyester resin H-1 (Tg: 56° C., THF insoluble component: 37% by mass, MI (190° C.) 1.1, Mn: 5300, Mw: 110,000, peak molecular weight: 8600, acid value: 24 mgKOH/g, hydroxyl value: 21 mgKOH/g) was obtained.

Polyester Resin Manufacturing Example 3

| | |
|---|---|
| Terephthalic acid | 15 parts by mass |
| Isophthalic acid | 4 parts by mass |
| Trimellitic anhydride | 9 parts by mass |
| Bisphenol derivative represented by the formula (A) (wherein R: propylene group, average of x + y = 2.2) | 70 parts by mass |
| Oxyalkylene ether of novolak type phenolic resin represented by the formula (C) (wherein R = ethylene group, average of x = 2.6, average of each of y1, y2, and y3 = 1.0) | 2 parts by mass |

0.5 parts by mass of dibutyltin oxide was added as a catalyst to the mixture above. A condensation polymerization reaction took place in the mixture at 240° C. Then cross-linked polyester resin H-2 (Tg: 58° C., THF insoluble component: 49% by mass, MI (190° C.) 0.2, Mn: 5400, Mw: 130,000, peak molecular weight: 9000, acid value: 16 mgKOH/g, hydroxyl value: 15 mgKOH/g) was obtained.

Polyester Resin Manufacturing Example 4

| | |
|---|---|
| Terephthlic acid | 21 parts by mass |
| Isophthalic acid | 5 parts by mass |
| Trimellitic anhydride | 3 parts by mass |
| Bisphenol derivative represented by the formula (A) (wherein R: propylene group, average of x + y = 2.2) | 70 parts by mass |
| Oxyalkylene ether of novolak type phenolic resin represented by the formula (C) (wherein R = ethylene group, average of x = 2.6, average of each of y1, y2, and y3 = 1.0) | 1 part by mass |

0.5 parts by mass of dibutyltin oxide was added as a catalyst to the mixture above. A condensation polymerization reaction took place in the mixture at 240° C. Then cross-linked polyester resin H-3 (Tg: 55° C., THF insoluble component: 22% by mass, MI (190° C.): 6.3, Mn: 5100, Mw: 100,000, peak molecular weight: 8200, acid value: 35 mgKOH/g, hydroxyl value: 26 mgKOH/g) was obtained.

Polyester Resin Manufacturing Example 5

| | |
|---|---|
| Terephthalic acid | 18 parts by mass |
| Isophthalic acid | 5 parts by mass |
| Trimellitic anhydride | 5 parts by mass |
| Bisphenol derivative represented by the formula (A) (wherein R: propylene group, average of x + y = 2.2) | 70 parts by mass |
| Oxyalkylene ether of novolak type phenolic resin represented by the formula (C) (wherein R = ethylene group, average of x = 2.6, average of each of y1, y2, and y3 = 1.0) | 2 parts by mass |

0.5 parts by mass of dibutyltin oxide was added as a catalyst to the mixture above. A condensation polymerization reaction took place in the mixture at 240° C. Then cross-linked polyester resin H-4 (Tg: 57° C., THF insoluble component: 13% by mass, MI (190° C.): 11.1, Mn: 4800, Mw: 70,000, peak molecular weight: 7900, acid value: 15 mgKOH/g, hydroxyl value: 40 mgKOH/g) was obtained.

Polyester Resin Manufacturing Example 6

| | |
|---|---|
| Terephtalic acid | 18 parts by mass |
| Isophthalic acid | 3 parts by mass |
| Trimellitic anhydride | 7 parts by mass |
| Bisphenol derivative represented by the formula (A) (wherein R: propylene group, average of x + y = 2.2) | 72 parts by mass |

0.5 parts by mass of dibutyltin oxide was added as a catalyst to the mixture above. A condensation polymerization reaction took place in the mixture at 240° C. Then cross-linked polyester resin H-5 (Tg: 59° C., THF insoluble component: 15% by mass, MI (190° C.): 11.8, Mn: 4700, Mw: 70,000, peak molecular weight: 7800, acid value: 37 mgKOH/g, hydroxyl value: 18 mgKOH/g) was obtained.

Polyester Resin Manufacturing Example 7

| | |
|---|---|
| Terephthalic acid | 11 parts by mass |
| Isophthalic acid | 5 parts by mass |
| Trimellitic anhydride | 10 parts by mass |
| Bisphenol derivative represented by the formula (A) (wherein R: propylene group, average of x + 7 = 2.2) | 74 parts by mass |

0.5 parts by mass of dibutyltin oxide was added as a catalyst to the mixture above. A condensation polymerization reaction took place in the mixture at 240° C. Then cross-linked polyester resin H-6 (Tg: 54° C., THF insoluble component: 12% by mass, MI (190° C.): 18.3, Mn: 4200, Mw: 60,000, peak molecular weight: 23,100, acid value: 33 mgKOH/g, hydroxyl value: 35 mgKOH/g) was obtained.

[Production of Binder Resins 1 to 5, and 7]

Low molecular weight polyester resin and cross-linked polyester resin were weighted according to ratios presented on Table 3. The resins were pre-mixed by using Henschell Mixer (manufactured by Mitsui Miike Kakouki Ltd.,), and the mixture was melted and blended using KRC kneader S1 (manufactured by Kurimoto Ironworks Co., Ltd.,) under a condition that an outlet resin temperature was set to 150° C., and binder resins were obtained. Also, refer to Table 3 for the acid values and the hydroxyl values of the binder resins obtained.

Now, regarding to the binder resin 6, the cross-linked polyester resin H-6 was used as it was without blending with the low molecular weight polyester resin, therefore, melting and blending was not performed as described above. The acid value and hydroxyl value of the cross-linked polyester resin H-6 are presented on the Table 3.

TABLE 3

| | Low moluclar weight polyester | | Cross-linked polyester | | | |
|---|---|---|---|---|---|---|
| Binder resin | Type | Part by mass (—) | Type | Part by mass (—) | Acid value (mgKOH/g) | Hydroxyl value (mgKOH/g) |
| Binder resin 1 | Low moluclar weight polyester resin L-1 | 50 | Cross-linked polyester resin H-1 | 50 | 18 | 31 |
| Binder resin 2 | Low moluclar weight polyester resin L-1 | 50 | Cross-linked polyester resin H-2 | 50 | 11 | 21 |
| Binder resin 3 | Low moluclar weight polyester resin L-1 | 50 | Cross-linked polyester resin H-3 | 50 | 31 | 28 |
| Binder resin 4 | Low moluclar weight polyester resin L-1 | 30 | Cross-linked polyester resin H-4 | 70 | 14 | 46 |
| Binder resin 5 | Low moluclar weight polyester resin L-1 | 30 | Cross-linked polyester resin H-5 | 70 | 36 | 22 |
| Binder resin 6 | — | — | Cross-linked polyester resin H-6 | 100 | 33 | 35 |
| Binder resin 7 | Low moluclar weight polyester resin L-1 | 30 | Cross-linked polyester resin H-6 | 70 | 44 | 49 |

Magnetic Iron Oxide Production Example 1

Sodium silicate was added to a ferrous sulfate aqueous solution so that a content of a silicon element would be 0.60% by mass with respect to an iron element. After that, a sodium hydroxide solution was mixed to this solution, and an aqueous solution containing ferrous hydroxide was prepared. The air was blown into the aqueous-solution while the pH of the aqueous solution was adjusted to 10 to allow an oxidization reaction to take place at a temperature of 80 to 90° C., and a slurry liquid forming a seed crystal was prepared.

Once the formation of the seed crystal was confirmed, an appropriate amount of a ferrous sulfate aqueous solution was added to this slurry liquid to allow the oxidation reaction to proceed while the pH of the slurry liquid was adjusted to 10 and the air was blown into the liquid. During this time, a rate of progressing of the reaction was checked at the same time as a concentration of unreacted ferrous hydroxide was being checked. An appropriate amount of zinc sulfate was added to the liquid, and the pH of the aqueous solution was controlled stepwise, that is, pH=9 at an initial stage of the oxidation reaction, pH=8 in a middle stage of the reaction, and pH=6 at a final stage of the reaction. This way, distributions of the metal elements inside the magnetic iron oxide were controlled, and thus the oxidation reaction was completed.

Subsequently, a water-soluble aluminum salt was added to an alkalescence suspension where the magnetic iron oxide particles containing silicon elements were being formed in an amount of 0.20% in terms of aluminum element, so that the magnetic iron oxide particle could contain an aluminum element. After that, the pH of the mixture was adjusted in the range of 6 to 8, and the water-soluble was precipitated as aluminum hydroxide on the magnetic iron oxide particle surface.

Then, after filtering, washing, drying, and pulverizing were performed, the magnetic iron oxide having an aluminum element on the magnetic iron oxide surface was obtained. The magnetic iron oxide particle formed was washed, filtered, and dried using a normal method.

The primary particles of the obtained magnetic iron oxide particles were agglomerated to form an agglomerate. A compression force and a shearing force were applied to the agglomerate of the magnetic iron oxide particles using a mix marler. The agglomerate was broken down to make the primary particles of the magnetic iron oxide particles. At the same time, the surfaces of the magnetic iron oxide particles were smoothened. Magnetic iron oxide 1 having properties shown in Table 4 was obtained accordingly.

Magnetic Iron Oxide Production Examples 2 to 5

Amounts and timings of adding sodium silicate, zinc sulfate, and the water soluble aluminum salt were changed, and the pH of the aqueous solution was changed to obtain magnetic iron oxides 2 to 5 having physical properties shown in Table 4.

TABLE 4

| Magnetic material | Isoelectric point (pH) | Si (%) | Zn (%) | Al (%) | Residual magnetization ($Am^3/kg$) | Particle diameter (μm) |
|---|---|---|---|---|---|---|
| Magnetic iron oxide 1 | 6.8 | 0.60 | 0.57 | 0.20 | 6.4 | 0.18 |
| Magnetic iron oxide 2 | 5.3 | 0.71 | 0.64 | 0.10 | 5.7 | 0.20 |

TABLE 4-continued

| Magnetic material | Isoelectric point (pH) | Si (%) | Zn (%) | Al (%) | Residual magnetization ($Am^3/kg$) | Particle diameter (μm) |
|---|---|---|---|---|---|---|
| Magnetic iron oxide 3 | 8.8 | 0.44 | 0.35 | 0.37 | 7.2 | 0.17 |
| Magnetic iron oxide 4 | 4.7 | 0.69 | 0.55 | — | 6.8 | 0.18 |
| Magnetic iron oxide 5 | 9.2 | 0.34 | 0.25 | 0.49 | 7.9 | 0.15 |

Example 1

| | |
|---|---|
| Binder resin 1 | 100 parts by mass |
| Magnetic iron oxide 1 | 100 parts by mass |
| Monoazo iron compound (refer to the formula VI) | 2 parts by mass |
| 3,5-di-t-butylsalicylic acid aluminum compound (refer to the formula VIII) | 0.5 part by mass |
| Fisher-Tropsch wax (heat absorbing peak temperature of DSC: 105° C., Mw: 2500, Mn: 1500, SP value: 8.4) | 4 parts by mass |

The above raw materials were pre-mixed by using Henschell Mixer. Then, the mixed materials were kneaded by using two-axis kneader and extruder (PCM30: manufactured by Ikegai ironworks Co., Ltd.,) set at 150° C., and 250 rpm. After the kneaded product was cooled, the kneaded product was roughly pulverized using a cutter mill. The obtained coarse pulverized material was finely pulverized using the turbo mill (T-250: manufactured by Turbo Industry Ltd.,) by setting an outlet temperature thereof to 45° C. The obtained fine pulverized powder was classified by using a fixed wall type wind power classifier. A negatively-charged magnetic toner particle having a weight average particle diameter (D4) of 6.4 μm was obtained. A proportion of the toner particle having a particle diameter of no more than 4.00 μm was 23.2 number % in the toner number distribution. A proportion of the toner particle having a particle diameter of 10.1 μm or more was 0.8% by volume in the volume distribution.

Toner 1 was obtained by externally adding and mixing 1.2 parts by mass of the negatively-charged hydrophobic fine powder silica for every 100 parts by mass of toner particles by means of the Henschell Mixer. The negatively-charged hydrophobic fine powder silica was obtained by hydrophobicizing (at a methanol wettability of 80% and a BET specific surface area of 120 $m^2/g$) the dry silica having a BET specific surface area of 200 $m^2/g$ using 10% by mass of hexamethyl disilazane and 20% by mass of dimethyl silicone oil (having a viscosity of 100 $mm^2/s$). Table 5 shows formulation of the toner 1. Table 6 shows physical properties of the toner 1.

TABLE 5

| | Binder resin | Magnetic material | Wax (SP value) | Charge control agent 1: Part by mass | Charge control agent 2: Part by mass |
|---|---|---|---|---|---|
| Example 1 | Binder resin 1 | Magnetic iron oxide 1 | Fische-Tropsch wax (8.4) | Monoazo iron compound (Compound VI): 2 part | Aromatic hydroxycarboxylic compound with aluminium (Compound VIII): 0.5 part |
| Example 2 | Binder resin 2 | Magnetic iron oxide 1 | Fische-Tropsch wax (8.4) | Monoazo iron compound (Compound VI): 2 part | Aromatic hydroxycarboxylic compound with aluminium (Compound VIII): 0.5 part |
| Example 3 | Binder resin 3 | Magnetic iron oxide 1 | Fische-Tropsch wax (8.4) | Monoazo iron compound (Compound VI): 2 part | Aromatic hydroxycarboxylic compound with aluminium (Compound VIII): 0.5 part |
| Example 4 | Binder resin 4 | Magnetic iron oxide 1 | Polyethylene wax (8.7) | Monoazo iron compound (Compound VI): 2 part | Aromatic hydroxycarboxylic compound with aluminium (Compound VIII): 0.5 part |
| Example 5 | Binder resin 5 | Magnetic iron oxide 1 | Polyethylene wax (8.7) | Monoazo iron compound (Compound VI): 2 part | Aromatic hydroxycarboxylic compound with aluminium (Compound VIII): 0.5 part |
| Example 6 | Binder resin 3 | Magnetic iron oxide 1 | Alcohol-denatured wax (9.2) | Monoazo iron compound (Compound VI): 2 part | Aromatic hydroxycarboxylic compound with aluminium (Compound VIII): 0.5 part |
| Example 7 | Binder resin 3 | Magnetic iron oxide 2 | Fische-Tropsch wax (8.4) | Monoazo iron compound (Compound VI): 2 part | Aromatic hydroxycarboxylic compound with aluminium (Compound VIII): 0.5 part |
| Example 8 | Binder resin 3 | Magnetic iron oxide 3 | Alcohol-denatured polyethylene wax (9.2) | Monoazo iron compound (Compound VI): 2 part | Aromatic hydroxycarboxylic compound with aluminium (Compound VIII): 0.5 part |
| Comparative example 1 | Binder resin 6 | Magnetic iron oxide 4 | Acid-denatured polyethylene wax (9.5) | Monoazo chromium compound (Compound VII): 1 part | Nil |
| Comparative example 2 | Binder resin 7 | Magnetic iron oxide 5 | Ester wax (9.3) | Monoazo chromium compound (Compound VII): 1 part | Nil |

TABLE 6

| | Methanol condentration | | Molucular weight distribution of THF soluble component | | | | |
|---|---|---|---|---|---|---|---|
| | at 80% transmittance (% by volume) | at 10% transmittance (% by volume) | Perk molucular weight (—) | Molucular weight no more than 10,000 (% by mass) | Number average molucular weight Mn (—) | Weight average molucular weight Mw (—) | Z average molucular weight Mz (—) |
| Example 1 | 59 | 60 | 9500 | 62 | 4200 | $9.2 \times 10^5$ | $1.2 \times 10^8$ |
| Example 2 | 52 | 54 | 9200 | 68 | 4000 | $8.0 \times 10^5$ | $6.6 \times 10^7$ |
| Example 3 | 53 | 54 | 9600 | 55 | 4500 | $1.0 \times 10^5$ | $1.3 \times 10^8$ |
| Example 4 | 51 | 53 | 9500 | 51 | 5000 | $6.5 \times 10^5$ | $3.7 \times 10^7$ |
| Example 5 | 50 | 54 | 9300 | 54 | 5800 | $5.0 \times 10^5$ | $2.0 \times 10^7$ |
| Example 6 | 49 | 52 | 9600 | 53 | 4500 | $1.0 \times 10^6$ | $1.2 \times 10^8$ |
| Example 7 | 48 | 50 | 9700 | 56 | 4600 | $1.1 \times 10^5$ | $1.2 \times 10^8$ |
| Example 8 | 46 | 49 | 9600 | 54 | 4600 | $1.1 \times 10^6$ | $1.2 \times 10^8$ |
| Example 9 | 59 | 60 | 9500 | 62 | 4200 | $9.2 \times 10^5$ | $1.2 \times 10^8$ |
| Comparative example 1 | 41 | 48 | 23700 | 41 | 6500 | $6.0 \times 10^4$ | $2.5 \times 10^6$ |
| Comparative example 2 | 43 | 52 | 13500 | 47 | 7000 | $1.2 \times 10^6$ | $8.8 \times 10^6$ |

| | THF insoluble compound (% by mass) | MI of toner (g/10 min) | Carr's floodability index (—) | Carr's fluidity index (—) |
|---|---|---|---|---|
| Example 1 | 21 | 1.7 | 91 | 70 |
| Example 2 | 23 | 0.6 | 90 | 69 |
| Example 3 | 12 | 5.4 | 90 | 69 |
| Example 4 | 7 | 9.5 | 89 | 66 |
| Example 5 | 6 | 8.9 | 89 | 65 |
| Example 6 | 11 | 5.7 | 88 | 68 |
| Example 7 | 12 | 5.5 | 87 | 68 |
| Example 8 | 12 | 5.6 | 86 | 68 |
| Example 9 | 21 | 1.7 | 92 | 70 |
| Comparative example 1 | 8 | 5.1 | 83 | 63 |
| Comparative example 2 | 3 | 12.3 | 82 | 61 |

This toner was evaluated based on the items below.

[Fixation Test]

Fixation Start Temperature

A fixing device was taken out from a Hewlett-Packard's laser beam printer Laser Jet 4100. A fixation temperature of the fixing device was designed to bear bitrary set. An external fixing device having a process speed of 290 mm/second was used. Temperature of this external fixing device was adjusted every 5° C. in the temperature range of 160 to 220° C. A plain black unfixed image (set toner developing amount to 0.6 mg/cm$^2$) developed to ordinary paper (75 g/m$^2$) was fixed, and the obtained image was scratched by 5 reciprocating motions using 4.9 kPa weighted sirubon paper. A temperature when the plain black image was obtained, which a density down ratio of image density was no more than 10% was defined as the fixation start temperature. The low temperature fixing property of the toner gets more excellent if the temperature is lower.

High Offset Temperature

Regarding to the high offset temperature, a process speed was set to 100 mm/second Temperature was adjusted every 5° C. in the temperature range of 200 to 240° C., and an unfixed image was fixed. A stain attached on the image due to the offset phenomenon was visually confirmed. The temperature at which the stain appeared was defined as the high offset temperature. The high temperature offset performance of the toner gets more excellent if this temperature is higher.

[Developing Performance and Durability Test]

Image Density After Endurance Under Normal Temperature Normal Humidity Environment The Hewlett-Packard's laser printer Laser Jet 4100 (A4 size, vertical orientation, 24 sheets/minute) was remodeled to process at twice the process speed (290 mm/second). Under a normal temperature normal humidity environment (23° C., 60% RH), using 75 g/m$^2$ transfer paper (A4 size) as transfer paper, a letter E pattern with a rate of an image area of 4% was printed for 1000 copies. Then, a solid plain black image was printed, and the image density was measured. The measurement of the image density was done by measuring a reflection density in 5 point average, with SPI filter using Macbeth densitometer (manufactured by Macbeth Ltd.,).

Charge-rise Evaluation

In addition, under a normal temperature low humidity environment (23° C., 5% RH), and using 75 g/m$^2$ transfer paper (A4 size) as transfer paper, double-sided images with an image area density of 1% were continuously printed for 5,000 copies. After this printing, a plain black image was output for 10 copies, and the image density was measured in the likewise manner as the previous plain black image density measurement. The table below shows the image density of the first plain black image and that of the tenth plain black image. No difference in image density means no charge-rise has occurred. There is a tendency that the first image density is thin and the tenth image density is thick if charge-rise has occurred.

Image Density Lowering After Neglect Under High Temperature and High Humidity Environment In addition, under a high temperature high humidity (32.5° C., 80% RH) environment, test print for 5,000 copies was conducted, followed by neglect for 3 days. Then, a solid black image was output and its image density was measured. Thus, the image density lowering after neglect under a high temperature and high humidity environment was confirmed.

[End-offset]

After printing of A5 sized transfer paper for 100 copies, A4 sized printing paper was continuously printed for 100 copies to visually confirm when the end offset disappeared by counting the number of papers. Toner is evaluated based on the standards below. Table 7 shows the evaluation results of the toner 1.

A: The end-offset dose not generated
B: The end-offset disappears by the 10th copy
C; The end-offset disappears by the 30th copy
D: The end-offset disappears by the 50th copy
E: The end-offset does not disappear over the 50th copy Examples 2 to 8

Toners 2 to 8 were obtained in the likewise manner as in Example 1 except that toner material composition was changed as shown in Table 5. Table 5 shows the formulation of the toners. Table 6 shows the physical properties of the obtained toners. In addition, the obtained toners were evaluated in the likewise manner as the toner 1. Table 7 shows the evaluation results of the obtained toners.

Example 9

The following external additives were externally added and mixed to the toner particle obtained in Example 1 by using Henschell Mixer to obtain the toner 9. Table 6 shows the physical properties of the toner 9.

| | |
|---|---|
| The negatively-charged hydrophobic fine powder silica was obtained by hydrophobicizing dry silica having a BET specific surface area of 200 m$^2$/g with 10% by mass of hexamethyldisilazane and 20% by mass of dimethyl silicone oil (with a viscosity of 100 mm$^2$/s), methanol wettability is 80%, the BET ratio surface area is 120 m$^2$/g). | 1.35 parts |
| Negatively-charged fine powder silica agglomerate containing dimethyl silicone oil of 60% by mass (the BET specific surface area is 2.5 m$^2$/g). | 0.1 parts |
| Positively-charged melamine resin particle (the BET specific surface area is 25 m$^2$/g). | 0.08 parts |
| Positively-charged strontium titanate particle (the BET specific surface area is 2.0 m$^2$/g). | 1.0 part |

The obtained toner 9 was evaluated in the likewise manner as the toner 1. The evaluation results of the obtained toner are shown in Table 7.

Comparative Examples 1 and 2

In the likewise manner as Example 1 except that toner material composition was changed as shown in Table 5 and a fine-grained grinder by the crushing type jet mill was used, comparative toners 1 and 2 were obtained. Table 5 shows the toner formulation. Table 6 shows the physical properties of the obtained toners. In addition, the obtained toners were evaluated in the likewise manner as the toner 1. The evaluation results of the obtained toners are shown in Table 7.

TABLE 7

| | Fixation start temperature (° C.) | High offset temperature (° C.) | End offset | Image density after endurance under normal temperature and normal humidity | Image density In charge rise evaluation: The first copy | Image density In charge rise evaluation: The tenth copy | Image density degradation after leaving: Immediately after the endurance | Image density degradation after leaving: After leaving |
|---|---|---|---|---|---|---|---|---|
| Example 1 | 170 | Not generated | A | 1.51 | 1.49 | 1.49 | 1.44 | 1.43 |

TABLE 7-continued

| | Fixation start temperature (° C.) | High offset temperature (° C.) | End offset | Image density after endurance under normal temperature and normal humidity | Image density In charge rise evaluation The first copy | Image density In charge rise evaluation The tenth copy | Image density degradation after leaving Immediately after the endurance | Image density degradation after leaving After leaving |
|---|---|---|---|---|---|---|---|---|
| Example 2 | 175 | Not generated | B | 1.46 | 1.44 | 1.46 | 1.41 | 1.37 |
| Example 3 | 175 | 235 | B | 1.45 | 1.41 | 1.44 | 1.40 | 1.34 |
| Example 4 | 180 | 225 | B | 1.42 | 1.36 | 1.40 | 1.38 | 1.30 |
| Example 5 | 185 | 220 | C | 1.38 | 1.30 | 1.37 | 1.33 | 1.23 |
| Example 6 | 180 | 220 | D | 1.34 | 1.21 | 1.32 | 1.30 | 1.19 |
| Example 7 | 180 | 230 | D | 1.32 | 1.19 | 1.31 | 1.27 | 1.14 |
| Example 8 | 185 | 215 | D | 1.30 | 1.11 | 1.29 | 1.21 | 1.02 |
| Example 9 | 170 | Not generated | A | 1.53 | 1.50 | 1.50 | 1.46 | 1.45 |
| Comparative example 1 | 205 | 230 | E | 1.34 | 1.02 | 1.33 | 1.25 | 0.94 |
| Comparative example 2 | 190 | 215 | E | 1.27 | 0.94 | 1.26 | 1.20 | 0.88 |

What is claimed is:

1. A toner comprising toner particles, each of the toner particles comprising at least a binder resin comprising a polyester resin as a main component, a wax, and a colorant, wherein in case of measuring a wettability of the toner with respect to a mixed solvent of methanol and water in terms of an optical transmittance at an optical wavelength of 780 nm, a methanol concentration of the mixed solvent is in a range of 45 to 65% by volume when the optical transmittance is 80%, and a methanol concentration of the mixed solvent is in a range of 45 to 65% by volume when the optical transmittance is 10%;

a melt index (MI) of the toner measured at a temperature of 125° C. and a load of 5 kg is in a range of 0.1 to 10 g/10 min;

the toner comprises a resin component insoluble to tetrahydrofuran (THF insoluble component) in an amount of 5 to 40% by mass based on a mass of the binder resin; and the toner comprises a tetrahydrofuran soluble component, and in case of measuring the tetrahydrofuran soluble component by gel permeation chromatography, a main peak is in a molecular weight region of 3,000 to 20,000, and a proportion of a component having a molecular weight of 10,000 or less in the tetrahydrofuran soluble component is 50% by mass or more in a chromatogram of the gel permeation chromatography.

2. The toner according to claim 1, wherein the polyester resin comprises (i) a low molecular weight polyester component having a main peak of molecular weight of the tetrahydrofuran soluble component being in the range of 3,000 to 20,000 and having 0 to 3% by mass of tetrahydrofuran insoluble component, and (ii) a cross-linked polyester component having 10 to 60% by mass of the tetrahydrofuran insoluble component; and the mass ratio of the cross-linked polyester component and the low molecular weight polyester component is in a range of 10:90 to 90:10.

3. The toner according to claim 2, wherein a melt index (MI) of the cross-linked polyester component is in a range of 0.1 to 10 g/10 min, at a temperature of 190° C. and a load of 10 kg.

4. The toner according to claim 1, wherein each of the toner particles comprises, based on 100 parts by mass of the binder resin, 0.1 to 5 parts by mass of an aromatic hydroxycarboxyl acid compound which has aluminum and 0.1 to 10 parts by mass of a monoazo iron compound.

5. The toner according to claim 1, wherein each of the toner particles comprises 30 to 200 parts by mass of a magnetic material based on 100 parts by mass of the binder resin.

6. The toner according to claim 5, wherein an isoelectric point of the magnetic material is in a range of pH 5 to 9, which is obtained from a zeta potential, and a solubility parameter of the wax (SP value) is 9 or less.

7. The toner according to claim 1, wherein the methanol concentration of the mixed solvent is in a range of 50% by volume or more and less than 65% by volume when the optical transmittance is 80%, and the methanol concentration of the mixed solvent is in a range of 50% by volume or more and less than 65% by volume when the optical transmittance is 10%.

8. The toner according to claim 1, a Carr's floodability index of the toner is greater than 80, and a Carr's fluidity index of the toner is greater than 60.

9. The toner according to claim 1, further comprising at least a hydrophobic fine powder of silica which becomes charged to a same polarity as a polarity of the toner, and a fine particle aggregate having 20 to 90% by mass of one of silicone oil and silicone varnish.

* * * * *